US005083872A

United States Patent [19]

Farling et al.

[11] Patent Number: 5,083,872

[45] Date of Patent: Jan. 28, 1992

[54] LIQUIDS MIXING AND DISPENSING SYSTEM

[75] Inventors: Duane J. Farling, Webster; Gary A. Smith, Rochester, both of N.Y.

[73] Assignee: Eastman Kodak Company, Rochester, N.Y.

[21] Appl. No.: 627,799

[22] Filed: Dec. 14, 1990

[51] Int. Cl.[5] ..... B01F 15/04

[52] U.S. Cl. ..... 366/138; 137/567; 366/161; 366/162

[58] Field of Search ..... 366/138, 152, 159, 160, 366/161, 162; 137/92, 93, 567, 571; 422/187, 188, 189, 197

[56] References Cited

U.S. PATENT DOCUMENTS

| | | | |
|---|---|---|---|
| 3,655,166 | 4/1972 | Sauer et al. | 259/27 |
| 3,779,518 | 12/1973 | Koepke et al. | 259/18 |
| 4,209,258 | 6/1980 | Oakes | 366/138 |
| 4,241,023 | 12/1980 | Wilke et al. | 422/187 |
| 4,305,669 | 12/1981 | Hope et al. | 366/152 |
| 4,334,884 | 6/1982 | Wilke | 366/176 |

*Primary Examiner*—Robert W. Jenkins

*Attorney, Agent, or Firm*—John B. Turner

[57] ABSTRACT

A liquids mixing and dispensing apparatus and method utilize a plurality of liquid supply modules to feed simultaneously charges of a plurality of admixable liquids at predetermined volume flow rates to a mixer to form a batch of a mixture of the liquids, such as a photographic emulsion mixture, in which the liquids are in a predetermined volume ratio. As it is formed, the mixture is delivered to a storage conduit connected to a dispenser, for later dispensing of a discrete volume thereof as a coating onto a moving web by feeding a purge liquid to the mixer. Each module has a piston and cylinder unit with an inlet and outlet (a cylinder port conduit) connected to one end of a tube having a volume at least as large as the maximum volume of the cylinder swept by its piston when driven by an associated motor. A valve selectively connects the other end of the tube either to a liquid source or to the mixer. The ratio of the intermediate or maximum volumes swept by the pistons when concordantly driven by their motors is selected to provide the desired volume ratio of the liquids in the mixture.

25 Claims, 1 Drawing Sheet

LIQUIDS MIXING AND DISPENSING SYSTEM

FIELD OF THE INVENTION

This invention relates to a liquids mixing and dispensing system for providing and dispensing a mixture of liquids whose volumes are precisely in a desired predetermined ratio. In particular, the invention relates to an emulsion dilution and delivery system used to prepare a predetermined volume mixture batch of a photographic emulsion, each of whose constituents is in a desired predetermined concentration, for dispensing a discrete volume sample thereof as a test coating onto a substrate.

BACKGROUND OF THE INVENTION

Arrangements are known for mixing liquids such as chemical suspensions and solutions in seeking to form a mixture in which the volumes of the liquids are in a predetermined ratio. The respective liquids are added successively in a specific order by metering pumps to control the respective liquid volumes and the mixture characteristics. In particular, a first liquid is fed by its metering pump as a continuous flow to a first mixer into which a second liquid is fed by its metering pump for flow as a mixture to the next mixer into which the next liquid is fed by its metering pump, until all the liquids are combined successively in sequence in the continuous flow.

U.S. Pat. No. 4,305,669 (Hope et al.) shows such an arrangement, formed as a liquid filled closed system free from gas or air, that contains successive circuits for continuous mixing of respective liquids fed by metering pumps in critical sequence at successive circuit points into the liquid flow.

U.S. Pat. No. 3,655,166 (Sauer et al.) shows a liquid filled column, divided by flow pressure openable, normally closed valves into successive mixing zones for preparing a photographic emulsion. Respective solutions of gelatine, potassium bromide, and silver nitrate, are fed by metering pumps in critical sequence to the successive mixing zones for continuous mixing and intermittent flow upwardly through the valves, with the mixture exiting from the top of the column.

U.S. Pat. No. 3,779,518 (Koepke et al.) shows a mixing arrangement for preparing a photographic emulsion in which the respective liquids are fed by metering pumps in sequence to successive mixing zones for continuous mixing.

U.S. Pat. Nos. 4,241,023 and 4,334,884 (both Wilke et al.) commonly show a mixing arrangement for preparing a photographic emulsion in which the respective liquids are fed by metering pumps in sequence to successive mixing zones for continuous mixing, but with ripening of the flow between mixing zones.

These known arrangements concern liquid mixture production that requires repeated cycle pumping by metering pumps to inject the liquids sequentially into the flow and displace the flow downstream in continuous manner. However, such repeated cycle pumping produces non-uniform pulsating flow, non-uniform metered liquid volume flow rates, and a mixture whose liquids are not in precise predetermined volume ratio. As each liquid must be metered into the flow at a precise flow rate relative to the others to provide the liquids in the mixture in precise predetermined volume ratio, such non-uniformity is undesirable.

These known arrangements are unsuited for simultaneously combining a plurality of liquids into a mixture in which their volumes are precisely in a predetermined ratio, for dispensing from a dispenser, by batch, rather than continuous, operation.

It is desirable to have a mixing and dispensing system, for simultaneously combining a plurality of liquids to form a mixture in which their volumes are precisely in a predetermined ratio, for dispensing from a dispenser, as a batch operation. It is especially desirable to have an emulsion dilution and delivery system for preparing a predetermined volume mixture batch of a photographic emulsion for dispensing a discrete volume sample thereof as a test coating onto a substrate.

SUMMARY OF THE INVENTION

This invention solves the foregoing problems by providing a liquids mixing and dispensing system, including an apparatus and method, for simultaneously combining a plurality of liquids to form a predetermined volume batch of a mixture in which the volumes of the liquids are precisely in a predetermined ratio, for dispensing from a dispenser.

The system contemplates batch operation, rather than continuous operation, and particularly comprises an emulsion dilution and delivery system for preparing a relatively small predetermined volume batch of a photographic emulsion for dispensing of a discrete volume sample thereof as a test coating onto a substrate.

The present invention is directed to apparatus comprising an enclosed flow arrangement that comprises a service line, a plurality of liquid supply modules, an energizable mixer for mixing the supplied liquids in a mixing path between its entrance and exit, a dispenser, and a delivery conduit. The delivery conduit connects the mixer exit to the dispenser so as to receive from the mixer the mixture of liquids, as it is formed, for delivery to the dispenser for dispensing therefrom. Each module comprises means for supplying a respective one of the liquids, a piston and cylinder unit having an inlet and outlet, drive means for selectively driving the piston relative to the cylinder between extreme positions or to any predetermined intervening position in the cylinder intermediate the extreme positions, and a tube having a predetermined internal volume between its opposed ends. The piston and cylinder unit has a predetermined maximum volume swept by the piston when moving from one to the other of the extreme positions. The tube internal volume is at least as large as, and preferably substantially equal to, the maximum swept volume of the cylinder of the piston and cylinder unit. One end of the tube is connected to the inlet and outlet. Each module also includes a main valve to connect the inlet and outlet of its piston and cylinder unit to the service line, and an alternate flow valve to connect selectively the other end of its tube either to its supplying means or to the mixer entrance. Conveniently, a secondary valve connects said one end of its tube to that inlet and outlet.

In particular, each drive means is an individually selectively operated variable speed stepper motor, each tube is a capillary tube, each alternate flow valve is connectable to the mixer entrance by a capillary charging conduit, and the delivery conduit is a capillary delivery conduit.

Control means may be provided for selectively individually controlling the driving of each drive means, the operation of each valve, and the energizing of the mixer.

Shifting means, e.g., controlled by the control means, may be included to shift the dispenser between an inactive position and an active position, for dispensing the mixture of liquids from the dispenser when it is shifted to the active position.

The method of the invention for combining the liquids in a predetermined volume ratio to form the predetermined volume batch of the mixture for dispensing from the dispenser, comprises effecting the following steps in the substantial absence of attendant gases in the enclosed flow apparatus (system) having the mixer connected by the delivery conduit to the dispenser:

feeding simultaneously respective predetermined volume charges of a plurality of admixable liquids in a predetermined volume ratio to the mixer at individual flow rates to form an incoming flow of the liquids in such ratio, while mixing the incoming flow in the mixer to form an outgoing flow of a mixture of the liquids in such ratio, such that the incoming flow displaces the outgoing flow from the mixer to the delivery conduit; and upon completing the feeding of the charges in the predetermined volume ratio, terminating the mixing and feeding a selective volume of a purge liquid to the mixer to displace a like volume of residual mixture from the mixer to the delivery conduit and to dispense a corresponding volume of the mixture from the dispenser.

The purge liquid is advantageously fed to the mixer at a selective dispensing rate to cause dispensing of the mixture from the dispenser at such dispensing rate.

The invention will be better understood from the following more detailed description taken with the accompanying drawings.

It is to be noted that the drawings are not to scale. Some portions are shown exaggerated to make the drawings easier to understand.

DETAILED DESCRIPTION

Figure 1:
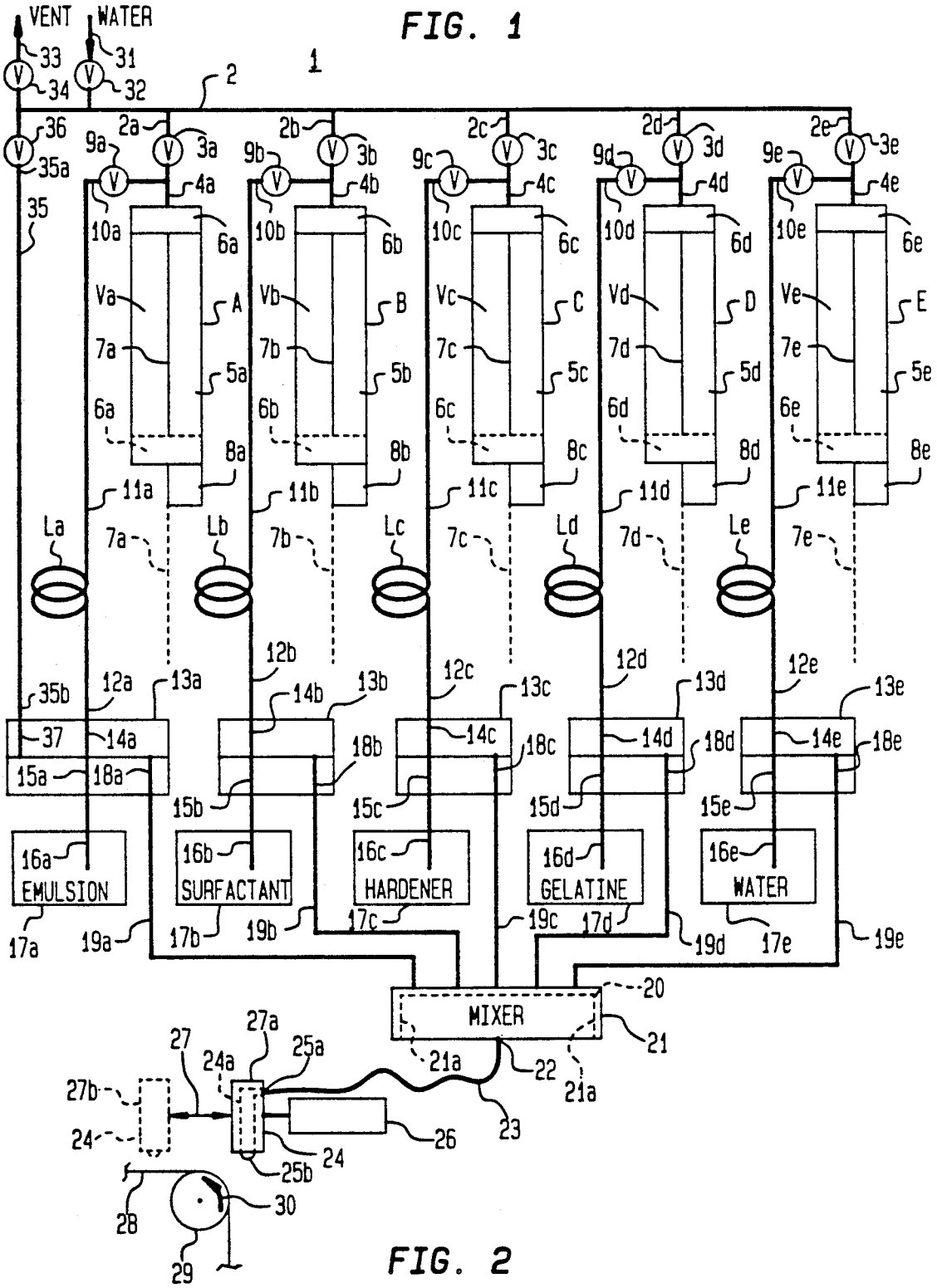
FIG. 1 is a schematic view of an apparatus in accordance with the present invention.

Referring now to FIG. 1, there is shown an apparatus 1 in accordance with the invention. Apparatus 1 is useful for mixing different liquids. Apparatus 1, by way of illustration, is useful for mixing up to five different admixable liquids, respectively supplied by five liquid supply modules A, B, C, D and E, to provide a mixture for dispensing to form a coating on a substrate (web) 28.

Apparatus 1 comprises a service conduit (line) 2 having branch conduits (lines) 2*a*, 2*b*, 2*c*, 2*d* and 2*e*, main (first) valves 3*a*, 3*b*, 3*c*, 3*d* and 3*e*, inlets and outlets (bifurcated conduits) 4*a*, 4*b*, 4*c*, 4*d* and 4*e*, cylinders 5*a*, 5*b*, 5*c*, 5*d* and 5*e* of maximum piston swept volumes Va, Vb, Vc, Vd and Ve, pistons 6*a*, 6*b*, 6*c*, 6*d* and 6*e* having piston rods 7*a*, 7*b*, 7*c*, 7*d* and 7*e*, motors 8*a*, 8*b*, 8*c*, 8*d* and 8*e*, secondary (second) valves 9*a*, 9*b*, 9*c*, 9*d* and 9*e*, dosage tubes 11*a*, 11*b*, 11*c*, 11*d* and 11*e* containing loops La, Lb, Lc, Ld and Le and having inlet ends 10*a*, 10*b*, 10*c*, 10*d* and 10*e*, and outlets ends 12*a*, 12*b*, 12*c*, 12*d* and 12*e*, multi-port alternate flow (third) valves 13*a*, 13*b*, 13*c*, 13*d* and 13*e* having tube ports 14*a*, 14*b*, 14*c*, 14*d* and 14*e*, intake (supply) ports 15*a*, 15*b*, 15*c*, 15*d* and 15*e* and exhaust (charging) ports 18*a*, 18*b*, 18*c*, 18*d* and 18*e*, draw lines 16*a*, 16*b*, 16*c*, 16*d* and 16*e* for liquid sources 17*a*, 17*b*, 17*c*, 17*d* and 17*e*, and dedicated conduits (charging lines) 19*a*, 19*b*, 19*c*, 19*d* and 19*e*. Apparatus 1 further comprises a mixer 21 having an entrance 20, an exit 22 and an internal flow path 21*a*, a delivery conduit (line) 23, a dispenser 24 having an inlet 25*a*, a discharge spout 25*b* and an internal conduit 24*a*, and a shifting device (shifter) 26 for shifting the dispenser 24 in the directions of arrow 27 between a drain (inactive) position 27*a* and a dispensing (active) position 27*b* for overlying a substrate (web) 28 located at the active position 27*b* and driven by a roll 29 rotating in the direction of arrow 30. Apparatus 1 still further comprises a water line 31, a water valve 32, a vent line 33, a vent valve 34, a back flush line 35 having upstream end 35*a* and downstream end 35*b*, a back flush valve 36, and a supplemental back flush port 37 in the third valve 13*a*.

Apparatus 1 is usable for rapidly making individual test batches of photographic chemical liquid mixtures in which the volumes of liquids in each mixture batch are precisely in a desired predetermined ratio, for dispensing a discrete volume sample thereof as a test coating onto a moving web.

As photographic chemical liquid mixtures are normally sensitive to light, apparatus 1 contemplates use in the dark. Apparatus (system) 1 operates as an enclosed flow system to form the liquid mixture in the substantial absence of attendant gases. As used herein, effecting production of the liquid mixture in the enclosed flow system of apparatus 1 in the substantial absence of attendant "gases", means in the substantial absence of air and/or other gas, such as that which may have originally existed in the enclosed flow system or have been introduced thereinto in any liquid fed to the system from one or more sources before the system is set up for effecting a desired mixing and dispensing operation, i.e., a test run.

Operation of apparatus 1 involves a series of steps to effect a preliminary run and a test run, some steps being optional, depending on the ongoing condition of the enclosed system and the predetermined volumes of the admixable liquids used relative to the maximum capacity of modules A to E.

These steps include a flushing step, a preliminary run including a draw step and an emptying step, and a test run including a draw step, a fill step, a mixing step and a purge step. The purge step includes an optional preliminary part for supplying a further amount of the admixable liquid of one of the modules as a purge liquid, an adjustment or back-off part, and a dispenser shifting and mixture dispensing part.

Apparatus 1 has the service conduit (line) 2 with the branch conduits (lines) 2*a*, 2*b*, 2*c*, 2*d* and 2*e* for servicing the five liquid supply modules A, B, C, D and E, whose associated components are essentially duplicates.

Branch lines 2*a* to 2*e* are connected by the respective main (first) valves 3*a*, 3*b*, 3*c*, 3*d* and 3*e* of modules A to E with upstream ends of the respective inlets and outlets (bifurcated lines) 4*a*, 4*b*, 4*c*, 4*d* and 4*e* at upper ends of respectively associated upright cylinders 5*a*, 5*b*, 5*c*, 5*d* and 5*e* that contain in their chambers respective pistons 6*a*, 6*b*, 6*c*, 6*d* and 6*e*. Pistons 6*a* to 6*e* are connected to their associated piston rods 7*a*, 7*b*, 7*c*, 7*d* and 7*e* that extend downwardly through the lower ends of cylinders 5*a* to 5*e*.

Pistons 6*a* to 6*e* are driven between the opposing upper and lower ends of the cylinders 5*a* to 5*e*, respectively, by associated motors 8*a*, 8*b*, 8*c*, 8*d* and 8*e* of modules A to E, respectively, that are located at the cylinder lower ends. Motors 8*a* to 8*e* are coupled by conventional screw drive mechanisms (not shown) to the respective piston rods 7*a* to 7*e*.

Motors 8*a* to 8*e* are energized to drive the respective pistons 6*a* to 6*e* individually and independently of each other in the respective cylinders 5*a* to 5*e*, between a lower filled extreme position (shown in dashed line in FIG. 1) and an upper empty extreme position (shown in solid line in FIG. 1), or precisely to any selective intervening position intermediate the extreme positions.

The downstream ends of the bifurcated lines 4*a* to 4*e* are connected by the respective secondary (second) valves 9*a*, 9*b*, 9*c*, 9*d* and 9*e* of modules A to E, respectively, with the inlet ends 10*a* to 10*e* of their associated dosage tubes 11*a*, 11*b*, 11*c*, 11*d* and 11*e*. The outlet ends 12*a*, 12*b*, 12*c*, 12*d* and 12*e* of dosage tubes 11*a* to 11*e* are connected to the respective multi-port alternate flow (third) valves 13*a*, 13*b*, 13*c*, 13*d* and 13*e* at the tube ports 14*a*, 14*b*, 14*c*, 14*d* and 14*e* thereof.

Intake (supply) ports 15*a*, 15*b*, 15*c*, 15*d* and 15*e* of third valves 13*a* to 13*e* are respectively connected with associated draw lines 16*a*, 16*b*, 16*c*, 16*d* and 16*e* of modules A to E whose exposed lower ends are inserted in respective liquid sources 17*a*, 17*b*, 17*c*, 17*d* and 17*e*, such as open containers of the liquids to be admixed.

Exhaust (charging) ports 18*a*, 18*b*, 18*c*, 18*d* and 18*e* of third valves 13*a* to 13*e* are respectively connected with the associated dedicated conduits (charging lines) 19*a*, 19*b*, 19*c*, 19*d* and 19*e* of modules A to E, which in turn are connected to a manifold entrance 20 (shown in dashed lines in FIG. 1) of a mixer 21, located downstream of modules A to E.

First valves 3*a* to 3*e* and second valves 9*a* to 9*e* are open or closed position type valves. First valves 3*a* to 3*e* and second valves 9*a* to 9*e* are normally open valves. On the other hand, third valves 13*a* to 13*e* are continuously open, shiftable type valves. In one position (an intake position), third valves 13*a* to 13*e* connect tube ports 14*a* to 14*e* with supply ports 15*a* to 15*e* and close off charging ports 18*a* to 18*e* from tube ports 14*a* to 14*e*. In the other position (an exhaust position), third valves 13*a* to 13*e* connect tube ports 14*a* to 14*e* with charging ports 18*a* to 18*e* and close off supply ports 15*a* to 15*e* from tube ports 14*a* to 14*e*.

The mixer 21 (including manifold entrance 20) is an enclosed flow path mixer having a predetermined small internal volume, e.g., 15 cc. A rotatable disc (not shown) or like conventional mixing element, energizable by a motor (not shown) in conventional manner for mixing liquids, is provided in an internal mixing path 21*a* (schematically indicated in FIG. 1 by dashed parallel lines) that connects entrance 20 and an exit 22 of mixer 21.

The exit 22 of mixer 21 is connected by a flexible delivery conduit (line) 23, formed of an ample slack-providing length of flexible plastic tubing, to a dispenser 24. Dispenser 24 receives the mixture of liquids from delivery conduit 23 via a receiving inlet 25*a* for dispensing from the dispenser via a discharge spout 25*b*. An internal dispenser conduit 24*a* (shown in dashed line) connects the inlet 25*a* and the spout 25*b*.

Delivery conduit 23 has a predetermined internal volume serving as a storage volume for a portion of the mixture of liquids mixed in mixer 21. This storage volume of delivery conduit 23 is selected to exceed the volume portion of the formed liquid mixture that is to be dispensed from dispenser 24 as the discrete volume sample that provides the test coating.

Dispenser 24 is coupled to a shifting device (shifter) 26 for shifting in the back and forth directions indicated by an arrow 27 between a drain (inactive) position 27*a* and a dispensing (active) position 27*b* (shown in phantom). As delivery line 23 is flexible, and is provided with ample slack, back and forth shifting of dispenser 24 occurs without strain on mixer 21 or any other component of apparatus 1.

When dispenser 24 is at active position 27*b*, it overlies a moving web 28, trained about a back-up roll 29 driven in rotation in a selective direction as indicated by arrow 30. At active position 27*b*, dispenser 24 is used to dispense from spout 25*b* a portion of the test run liquid mixture received from delivery conduit 23, as the discrete volume sample, for deposition onto web 28 as the test coating.

After web 28 is coated with the discrete volume sample, it may pass through various operation stages, including drying stations, etc., before the coating is subjected to scrutiny in a given test procedure. This invention is not concerned with that test procedure.

Dispenser 24 may be a conventional flat nozzle type liquid coating dispenser of predetermined internal volume, e.g., 1.2 cc. Dispenser conduit 24*a* may be a ribbon-like conduit (extending downwardly from inlet 25*a* to spout 25*b*) having a horizontal length (e.g., 5 cm) shorter than the transverse width of web 28, and a capillary horizontal width (e.g., 0.0001 inch). The capillary width of dispenser conduit 24*a* enables a desired thickness coating to deposit onto web 28 in dependence upon the predetermined moving speed of the web and the predetermined flow rate at which the mixture is dispensed from spout 25*b*.

Spout 25*b* constitutes a downwardly facing open slot that conforms to the horizontal cross section of dispenser conduit 24*a*. Due to its capillary horizontal width, when dispenser conduit 24*a* is filled with liquid in static condition, the attendant surface tension forms a downwardly facing meniscus across the open slot constituted by spout 25*b*. This tends to inhibit dripping of liquid from spout 25*b*.

The modules A to E comprise respectively the first valves 3*a* to 3*e*, the piston and cylinder units of the bifurcated lines 4*a* to 4*e*, the cylinders 5*a* to 5*e* and the pistons 6*a* to 6*e* and piston rods 7*a* to 7*e*, the motors 8*a* to 8*e*, the second valves 9*a* to 9*e*, the dosage tubes 11*a* to 11*e*, the third valves 13*a* to 13*e*, the draw lines 16*a* to 16*e* for the liquid sources 17*a* to 17*e*, and the charging lines 19*a* to 19*e*.

Modules A to E are operatively situated between the respective upstream branch lines 2*a* to 2*e* of service line 2 and the downstream series of mixer 21, delivery line 23 and dispenser 24, which define a downstream enclosed series flow path from entrance 20 of mixer 21 to spout 25*b* of dispenser 24.

The liquid source 17*a* may be a test sample of photographic emulsion, e.g., an aqueous dispersion of minute silver halide crystals in gelatine. Liquid source 17*b* may be a surfactant to reduce surface tension in applying the liquid mixture as a coating. Liquid source 17*c* may be a hardener for hardening the mixture at a later stage of the test operation, once the coating has been dispensed. Liquid source 17*d* may be an aqueous gelatine solution to supplement the gelatine content of the emulsion of liquid source 17*a*. Liquid source 17*e* may be distilled or deionized water (i.e., chemically pure water) to dilute the other constituents in the formed mixture.

Each of the liquids represented by liquid sources 17*a* to 17*e* is of known concentration. Specifically, the weight/volume ratio of each constituent in each liquid is known. Thus, the desired amount of each of these constituents in the discrete volume sample dispensed as the test coating may be predetermined by selecting dosage charge volumes of the liquids used to form the mixture batch that provide a volume ratio corresponding to the desired amounts of these constituents.

The nature of these admixable liquids is such that they cannot be combined ahead of time, as this could disturb the integrity of the test procedure and produce unreliable or inaccurate test results. For instance, the hardener content of liquid source 17*c* could cause premature aging or hardening of the emulsion content of liquid source 17*a* and gelatine content of liquid source 17*d*, and prevent the surfactant content of liquid source 17*b* from properly exerting its surface tension reducing effect on the mixture. Also, the characteristics of the emulsion formulation of liquid source 17*a*, which generally constitute the variables tested by a given test procedure, may be undesirably modified by such premature admixing.

A water line 31 is connected by a water valve 32 to service line 2 for supplying service water to service line 2, and a vent line 33 is connected by a vent valve 34 to service line 2 for venting service line 2 to the atmosphere. Water line 31 may be a pressure source of hot distilled or deionized, i.e., chemically pure, water, e.g., at about 40° C. (104° F.) and 20 pounds per square inch gage (psig) delivery pressure. A back flush line 35 is connected at an upstream end 35*a* to service line 2 by a back flush valve 36, and is connected at a downstream end 35*b* to a supplemental back flush port 37 in third valve 13*a*.

Water valve 32, vent valve 34 and back flush valve 36 are open or closed position type valves, like first valves 3*a* to 3*e* and second valves 9*a* to 9*e*. Water valve 32 and back flush valve 36 are normally closed, while vent valve 34 is normally open.

The third valve 13*a* is specifically formed as a dual connection valve that flow connects back flush line 35 with supply port 15*a* when the valve 13*a* is set to connect tube port 14*a* with charging port 18*a*. When the third valve 13*a* is set to connect tube port 14*a* with supply port 15*a*, back flush port 37 is at neutral position and is closed off from supply port 15*a*.

Apparatus 1 is so arranged that service line 2, modules A to E and their components (particularly bifurcated lines 4*a* to 4*e*, dosage tubes 11*a* to 11*e* and charging lines 19*a* to 19*e*), plus mixer 21, delivery line 23 and dispenser 24, collectively define an enclosed flow system controlled by valves 3*a* to 3*e*, 9*a* to 9*e*, 13*a* to 13*e*, 32, 34 and 36. The enclosed flow system can be supplied with liquids via water line 31 and/or draw lines 16*a* to 16*e*, and made free from air or other gas via upstream vent line 33 and downstream spout 25*b*. As such, apparatus 1 is essentially an enclosed system.

Valves 3*a* to 3*e*, 9*a* to 9*e*, 13*a* to 13*e*, 32, 34 and 36, cylinders 5*a* to 5*e*, pistons 6*a* to 6*e*, piston rods 7*a* to 7*e*, motors 8*a* to 8*e*, mixer 21, dispenser 24, shifter 26, web 28 and roll 29, are all of known construction.

Valves 3*a* to 3*e*, 9*a* to 9*e*, 13*a* to 13*e*, 32, 34 and 36 may be pneumatic valves arranged in known manner for individual independent actuation, e.g., with a 4 second switching response time. Motors 8*a* to 8*e* are also arranged in known manner for individual independent actuation, and the same is true of mixer 21 and shifter 26. Shifter 26 may be a pneumatic piston and cylinder unit operated to move dispenser 24 between positions 27*a* and 27*b*.

In particular, for precise operation of apparatus 1 according to the invention, the five units of the cylinders 5*a* to 5*e* and their pistons 6*a* to 6*e* are provided as known small size standard syringes. Motors 8*a* to 8*e* are provided as known individually selectively operated variable speed stepper motors. Stepper motors 8*a* to 8*e* may be micro-stepper motors capable of operating at 25,000 steps per revolution to drive pistons 6*a* to 6*e* in precise, very small, increments of travel.

For the same reason, bifurcated lines 4*a* to 4*e*, dosage tubes 11*a* to 11*e*, draw lines 16*a* to 16*e*, charging lines 19*a* to 19*e* and delivery line 23 are capillary size tubes or conduits, e.g., of about 1/16" (0.0625") to ⅛" (0.1250") internal diameter (I.D.). Back flush line 37 may also be a capillary conduit.

At these sizes, the 1/16" I.D. tubes or conduits have a calculated flow cross sectional area of 0.003069 $in^2$ (0.0198009 $cm^2$), while the ⅛" I.D. tubes or conduits have a calculated flow cross sectional area of 0.0122766 $in^2$ (0.0792047 $cm^2$).

Capillary bifurcated lines 4*a* to 4*e* are of small size and negligible (essentially zero) internal volume, i.e., functioning as cylinder port conduits just sufficient to provide flow connections between the respective ports at the upper ends of cylinders 5*a* to 5*e* and the first valves 3*a* to 3*e*, and also between such ports and the second valves 9*a* to 9*e*. The lengths of capillary charging lines 19*a* to 19*e* are desirably relatively short, and the size of mixer 21 is desirably relatively small.

In this way, the internal volumes of these components are minimized for more precise and responsive performance of apparatus 1, and for reducing consumption of the admixable liquids in preparing the mixture batch.

While the length of capillary delivery line 23 is also desirably minimized for the same reasons, its length must be sufficient to provide enough internal storage volume to hold an ample portion of the produced mixture therein for later discharge from spout 25*b* onto web 28 as the discrete volume sample providing the test coating.

For like reasons, cylinders 5*a* to 5*e* have comparatively small maximum swept volumes Va, Vb, Vc, Vd and Ve, respectively, when pistons 6*a* to 6*e* are driven by stepper motors 8*a* to 8*e* between extreme positions in the chambers of the cylinders, i.e., when the pistons move from one to the other extreme position in the cylinders (executing one full unidirectional stroke).

For example, cylinders 5*a* to 5*e* may have maximum swept volumes Va to Ve of 25 cc, 2.5 cc, 5 cc, 25 cc and 25 cc, respectively, for a corresponding predetermined fixed volume ratio of 1 (Va for module A) to 0.1 (Vb for module B) to 0.2 (Vc for module C) to 1 (Vd for module D) to 1 (Ve for module E). Of course, cylinders 5*a* to 5*e* are not limited to these specific volumes or their stated fixed ratio. Cylinders 5*a* to 5*e* may have any desired maximum swept volumes Va to Ve to provide any desired predetermined volume ratio when their pistons are driven from one extreme position to the other, or to any intervening position in their cylinders intermediate the extreme positions.

In accordance with a first purge liquid embodiment, the volume Ve of cylinder 5*e* of module E should be large enough to provide an excess volume over the volume thereof corresponding to the volume of the admixable liquid from source 17*e*, e.g., water, fed from dosage tube 11*e* to mixer 21 to form the mixture batch, as described below. This excess volume in cylinder 5*e* should be at least as large as the discrete volume sample dispensed to provide the test coating on web 28. This excess volume in cylinder 5*e* enables subsequent feeding of a like excess volume of that admixable liquid (water) from dosage tube 11*e* to mixer 21 as purge liquid to dispense the discrete volume sample onto web 28, as described below.

In accordance with an alternative second purge liquid embodiment, the volume Vd of cylinder 5*d* should be large enough to provide an excess volume over the volume thereof corresponding to the volume of the admixable liquid from source 17*d*, e.g., aqueous gelatine solution, fed from dosage tube 11*d* to mixer 21 to form the mixture batch, as described below. This excess volume in cylinder 5*d* should likewise be at least as large as the discrete volume sample dispensed to provide the test coating on web 28. As in the first purge liquid embodiment, this excess volume in cylinder 5*d* in the second purge liquid embodiment enables subsequent feeding of a like excess volume of the admixable liquid (gelatine solution) from dosage tube 11*d* to mixer 21 as purge liquid to dispense the discrete volume sample onto web 28.

The collective maximum swept volumes Va to Ve of modules A to E should exceed the sum of the collective internal volumes of charging lines 19*a* to 19*e*, plus the internal volumes of mixer 21, delivery line 23 and dispenser 24. This assures that the volumes of the admixable liquids used to form the mixture batch are potentially ample enough to fill charging lines 19*a* to 19*e*, mixer 21, delivery line 23 and dispenser 24, preferably with overflow of some of the mixture from spout 25*b*. This in turn assures that the discrete volume sample dispensed onto web 28 is free from attendant air or other gas, as described below.

According to a significant feature of the invention, capillary dosage tubes 11*a* to 11*e* have internal volumes, defined between their opposing ends 10*a* to 10*e* and 12*a* to 12*e*, that are at least as large as, and preferably substantially equal to, the respective maximum swept volumes Va to Ve in cylinders 5*a* to 5*e* of modules A to E.

To accommodate these differing volumes Va to Ve in the various portions of the enclosed flow path of apparatus 1, for example, the associated dosage tubes 11*a*, 11*d* and 11*e*, draw lines 16*a*, 16*d* and 16*e* and charging lines 19*a*, 19*d* and 19*e* of the larger size modules A, D and E, plus delivery line 23, may be of ⅛" I.D. capillary size. Concordantly, the associated dosage tubes 11*b* and 11*c*, draw lines 16*b* and 16*c* and charging lines 19*b* and 19*c* of the smaller size modules B and C may be of 1/16" I.D. capillary size. Back flush line 35 of module A may also be of ⅛" I.D. capillary size.

Dosage tubes 11*a* to 11*e* may each be coiled to form a plurality of loops La, Lb, Lc, Ld and Le to compress (i.e., into a compact space) the length of each such tube needed to provide it with an operative internal volume at least as large as the maximum swept volume Va to Ve of its associated cylinder 5*a* to 5*e*.

Pistons 6*a* to 6*e* are arranged in cylinders 5*a* to 5*e* so that no dead spaces exist when the pistons are driven from lower filled position to upper empty position. By vertical placement of cylinders 5*a* to 5*e* with their capillary bifurcated lines 4*a* to 4*e* at their upper ends, any air or other gas originally present in the cylinders is expelled via the extremely small volume bifurcated lines into the downstream portions of the enclosed system when pistons 6*a* to 6*e* are moved to upper position while first valves 3*a* to 3*e* are closed and second valves 9*a* to 9*e* are open. This air or other gas is removed by the flushing step, as described below.

Apparatus 1 is only operated for a test run (i.e., to form the test mixture batch, of which a portion is dispensed as the discrete volume sample onto web 28) with its enclosed flow path from upstream service line 2 to downstream spout 25*b*, plus draw lines 16*a* to 16*e*, filled with liquid, so that air or other gas is absent from all parts of the internal flow path.

This is accomplished by a flushing step in an initial setting up procedure when dispenser 24 is at inactive position 27*a*, mixer 21 is deenergized, pistons 6*a* to 6*e* are at upper empty position in cylinders 5*a* to 5*e* and liquid source 17*a* has been removed (this usually being the only liquid source that is exchanged between successive operations of apparatus 1).

Initially, the third valves 13*a* to 13*e* are set to connect tube ports 14*a*, 14*b*, 14*c*, 14*d* and 14*e* with charging ports 18*a*, 18*b*, 18*c*, 18*d* and 18*e*, thus connecting back flush port 37 with supply port 15*a*. Vent valve 33 is then closed, and first valves 3*a* to 3*e*, second valves 9*a* to 9*e*, back flush valve 36 and water valve 32 are opened.

This causes water (which acts as service liquid) under pressure from water line 31 to flow via service line 2 and branch lines 2*a* to 2*e* in one stream through each of bifurcated lines 4*a* to 4*e*, dosage tubes 11*a* to 11*e* and charging lines 19*a* to 19*e*, and in turn commonly through mixer 21, delivery line 23 and dispenser 24. This flushing stream discharges from spout 25*b* and is sent to a drain (not shown). Water also flows via service line 2 in another stream through back flush line 35 to clean draw line 16*a* of a previous liquid sample, e.g., photographic emulsion per liquid source 17*a*. The latter flushing stream discharges from the exposed lower end of draw line 16*a* and is also sent to a drain (not shown).

Then, first valves 3*a* to 3*e*, water valve 32 and back flush valve 36 are closed, while second valves 9*a* to 9*e* remain open. Vent valve 34 may be opened to equalize the pressure in service line 2 and branch lines 2*a* to 2*e*, i.e., in those upstream portions of the system. The flushing step scavenges any air or other gas from the enclosed flow system by entrainment in the stream discharging from spout 25*b* or in the stream discharging from the lower end of draw line 16*a*. It also fills all portions of the enclosed system with water as a system service liquid.

After the flushing step, third valves 13*a* to 13*e* are set to connect tube ports 14*a* to 14*e* with supply ports 15*a* and 15*e*, and the new test liquid per source 17*a* is positioned so that the lower end of draw line 16*a* is inserted in the new liquid source 17*a*.

Usually, a disposable filter element (not shown) is placed at the lower end of draw line 16*a* to prevent introduction via draw line 16*a* into dosage tube 11*a* of any contaminant particles (e.g., undissolved gelatine particles, hair, dirt particles, and the like) that may be present in the photographic emulsion constituted by liquid source 17*a*. As that photographic emulsion is an aqueous mixture (e.g., including silver halide and gelatine in selective amounts), which is normally individually formulated for a given test run, it is exposed to inclusion of these contaminant particles therein. Unless sufficiently dilute or kept warm, there is a tendency for some gelatine particles to remain undissolved (unmelted) in the emulsion. On the other hand, as the liquids constituted by liquid sources 17*b* to 17*e*, respectively, are typically obtained and supplied in chemically pure form (e.g., as preformulated, filtered and sufficiently dilute organic solvent or aqueous solutions of surfactant, hardener and gelatine, and as water itself, as the case may be), they are not generally exposed to such contaminant particle inclusion. Hence, the need for filtering liquid sources 17*b* to 17*e* at draw lines 16*b* to 16*e* does not normally arise.

The filter element at draw line 16*a* specifically serves to remove any such contaminant particles that would block the small capillary tubing in the enclosed system. However, this filter element tends to have adhering air at its surface and in its confines that may be introduced into the enclosed system via draw line 16*a*. Also, the fact that the lower end of draw line 16*a* is exposed to the air during the flushing step constitutes another source of air that may be introduced into the system via draw line 16*a*.

Since liquid sources 17*b* to 17*e* are normally not changed from one operation to the next, and thus are not flushed by the flushing step, the problem of air introduction through draw lines 16*b* to 16*e* does not occur. However, if any of liquid sources 17*b* to 17*e* are removed from draw lines 16*b* to 16*e*, e.g., for exchange by a different liquid source, air can be introduced into the apparatus 1 through these exposed draw lines.

For this reason, as part of the setting up of apparatus 1, after the flushing step, the apparatus 1 is preconditioned by a preliminary run to assure that any air that may be introduced via any of draw lines 16*a* to 16*e* is also flushed from the apparatus 1 by downstream flow, before the test run is undertaken. Draw lines 16*a* to 16*e* are always filled with the respective admixable liquids from sources 17*a* to 17*e*, and completely free from air or other gas, during the test run.

As normally only draw line 16*a* is subjected to the flushing step, it is filled with water as service liquid, while draw lines 16*b* to 16*e* remain filled with their respective admixable liquids from a previous operation. However, if any of draw lines 16*b* to 16*e* require flushing, then a supplemental flushing step is effected. This is carried out by repeating the flushing step, as described above, upon correspondingly removing liquid sources 17*b* to 17*e* from draw lines 16*b* to 16*e* and setting third valves 13*b* to 13*e* to connect tube ports 14*b* to 14*e* with supply ports 15*b* to 15*e*, as the case may be. The flushing water stream from water line 31, flowing via service line 2 and branch lines 2*b* to 2*e*, and respectively passing through dosage tubes 11*b* to 11*e* and exiting from the exposed lower ends of draw lines 16*b* to 16*e*, is similarly sent to a drain (not shown).

On completing the supplemental flushing step, the correspondingly flushed draw lines 16*b* to 16*e* are also filled with water as service liquid. The new liquids per sources 17*b* to 17*e*, as the case may be, are then positioned so that the lower ends of the respective draw lines 16*b* to 16*e* are inserted in the new liquid sources 17*b* to 17*e*, whereupon the preliminary run is undertaken.

Apparatus 1 is set for starting a preliminary run with dispenser 24 at the inactive position 27*a*, mixer 21 deenergized, first valves 3*a* to 3*e* and back flush valve 36 closed, pistons 6*a* to 6*e* at upper empty position, second valves 9*a* to 9*e* open, and third valves 13*a* to 13*e* set to connect tube ports 14*a* to 14*e* with charging ports 18*a* to 18*e*. Service liquid (e.g., chemically pure water) from the flushing step fills bifurcated lines 4*a* to 4*e*, dosage tubes 11*a* to 11*e*, charging lines 19*a* to 19*e*, dosage tubes 11*a* to 11*e*, charging lines 19*a* to 19*e*, mixer 21, delivery line 23 and dispenser 24.

As second valves 9*a* to 9*e* are normally open and third valves 13*a* to 13*e* are continuously open (either connecting tube ports 14*a* to 14*e* with supply ports 15*a* to 15*e* or with charging ports 18*a* to 18*e*), it is clear that, on closing first valves 3*a* to 3*e*, only charges of service liquid are filled into cylinders 5*a* to 5*e* from dosage tubes 11*a* to 11*e*, and emptied from the cylinders into the tubes, during operation of pistons 6*a* to 6*e*.

These service liquid charges, corresponding at most to maximum swept volumes Va to Ve, act as ballast or control liquid. This service liquid flows alternately between cylinders 5*a* to 5*e* and dosage tubes 11*a* to 11*e* on driving or sweeping pistons 6*a* 6*e* between the opposed ends of the cylinders or to any intervening position in the cylinders intermediate the extreme positions.

While second valves 9*a* to 9*e* are only needed to close off cylinders 5*a* to 5*e* from dosage tubes 11*a* to 11*e* for convenient flow control purposes, e.g., in servicing apparatus 1 between periods of normal operation, first valves 3*a* to 3*e* are required to close off cylinders 5*a* to 5*e* from branch lines 2*a* to 2*e* and service line 2 during normal operation of apparatus 1. This is true even though water valve 32, vent valve 34 and back flush valve 36 can be kept closed. If first valves 3*a* to 3*e* remained open, flow disturbing undesired mixing would occur between the otherwise static service liquid in branch lines 2*a* to 2*e* and service line 2 and the dynamic service liquid flowing at individually differing flow rates to and from dosage tubes 11*a* to 11*e* during operation of pistons 6*a* to 6*e*. That undesired mixing would adversely affect the required precisely responsive respective flows of the service liquid between cylinders 5*a* to 5*e* and dosage tubes 11*a* to 11*e*.

To start the preliminary run, tube ports 14*a* to 14*e* of valves 13*a* to 13*e* are connected with supply ports 15*a* to 15*e*. Then, in a preliminary run draw step, pistons 6*a* to 6*e* are simultaneously driven to lower filled position at a selective filling speed. The filling movement of pistons 6*a* to 6*e* draws under hydraulic suction the Va to Ve volume charges of service liquid from dosage tubes 11*a* to 11*e* into cylinders 5*a* to 5*e*.

This movement of pistons 6*a* to 6*e* simultaneously also draws under that same hydraulic suction corresponding Va to Ve volume dosage charges of the admixable liquids from sources 17*a* to 17*e* into dosage tubes 11*a* to 11*e* via draw lines 16*a* to 16*e* in a manner analogous to the intake action of a pipette. Since draw line 16*a*, and any of the draw lines 16*b* to 16*e* that may have been subjected to flushing, contain service liquid at the start of the preliminary run, this service liquid is also drawn into the concordant dosage tube as a part of the volume dosage charge that corresponds to the pertinent Va to Ve volume. As this preliminary run draw step (i.e., drawing of the admixable liquid charges from liquid sources 17*a* to 17*e* via draw lines 16*a* to 16*e* into dosage tubes 11*a* to 11*e*) may introduce air into the dosage tubes, and as the liquids being drawn into the dosage tubes via the draw lines include flushing step service liquid, at least in the case of draw line 16*a*, the preliminary run charges of these admixable liquids are not used (for the test run).

Third valves 13*a* to 13*e* are next set to connect tube ports 14*a* to 14*e* with charging ports 18*a* to 18*e*. Then, in a preliminary run emptying step, pistons 6*a* to 6*e* are simultaneously driven to upper empty position. This emptying movement of pistons 6*a* to 6*e* causes the service liquid charges to flow from cylinders 5a to 5e back into dosage tubes 11a to 11e, thereby emptying or displacing the preliminary run charges of the admixable liquids and attendant flushing step service liquid, that may contain air, from the tubes into and through charging lines 19a to 19e, deenergized mixer 21, delivery line 23 and dispenser 24.

This displaces the service liquid (e.g., water) previously filling the charging lines, mixer, delivery line and dispenser. The service liquid is discharged from spout 25b and purged from the system. As the preliminary run admixable liquid charges are displaced through the apparatus 1 immediately behind the service liquid, they are also purged from the apparatus 1 by discharge from spout 25b. For instance, an initial part thereof may be discharged with the purged service liquid, and a remainder part thereof may be discharged later, upon effecting downstream flow of the set of admixable liquid dosage charges for the test run.

The apparatus 1 is now filled with service liquid in bifurcated lines 4a to 4e and dosage tubes 11a to 11e, so as to exclude air or other gas therefrom, and with the preliminary run admixable liquids (that may contain air) individually in charging lines 19a to 19e and in random mixture in mixer 21, delivery line 23 and dispenser 24.

At this point the test run operation can be effected. To start a test run, third valves 13a to 13e are set to connect tube ports 14a to 14e with supply ports 15a to 15e. Next, in the test run draw step, pistons 6a to 6e are simultaneously driven to lower filled position to draw into dosage tubes 11a to 11e a test batch of dosage volumes of the admixable liquids from sources 17a to 17e via now liquid filled, air-free, draw lines 16a to 16e. This test run draw step filling movement of pistons 6a to 6e is effected at a sufficiently slow flow rate (e.g., at half the maximum speed of stepper motors 8a to 8e) to prevent formation of a disturbing temporary vacuum condition, as might occur if the pistons were driven at the maximum stepper motor speed. This disturbing vacuum condition could cause undue (excessively high) suction introduction into tubes 11a to 11e via draw lines 16a to 16e of the respective admixable liquids that could disturb the gas-free disposition of such liquids in the enclosed system.

Then, third valves 13a to 13e are set to connect tube ports 14a to 14e with charging ports 18a to 18e. Next, a test run fill step is effected.

In the test run fill step, pistons 6a to 6e are simultaneously driven by stepper motors 8a to 8e at selective individual speeds toward upper empty position for concordant volume flow rate filling or priming of charging lines 19a to 19e alone with the respective test run admixable liquids from dosage tubes 11a to 11e. This test run fill step displaces the preliminary run admixable liquids from charging lines 19a to 19e into mixer 21 as a random mixture, causing further discharge of downstream portions thereof from spout 25b. Any flushing step service liquid and preliminary run introduced air or other gas, previously present in dosage tubes 11a to 11e, draw lines 16a to 16e and/or charging lines 19a to 19e, have now been discharged downstream of charging lines 19a to 19e in the random mixture of the preliminary run admixable liquids.

The system is now ready for a test run mixing step.

To effect the test run mixing step, mixer 21 is energized, and at the same time pistons 6a to 6e are simultaneously driven toward upper empty position at respective selective dilution speeds as predetermined by stepper motors 8a to 8e. This emptying movement of pistons 6a to 6e causes the service liquid charges to flow from cylinders 5a to 5e back into dosage tubes 11a to 11e at individual volume flow rates determined by the individual corresponding speed of upward movement of the pistons. These volume flow rates correspond to the precisely desired predetermined volume ratio of the admixable liquid dosage charges in the predetermined volume mixture batch to be produced in the test run.

As the service liquid charges from cylinders 5a to 5e return to dosage tubes 11a to 11e, they displace the test run admixable liquid dosage charges simultaneously from the dosage tubes at the same individual volume flow rates for simultaneous feeding via charging lines 19a to 19e to mixer 21 at such flow rates. The initial portions of these test run admixable liquids that enter mixer 21 are those priming portions located in charging lines 19a to 19e that had been previously fed to the charging lines in the test run fill step. Accordingly, those priming portions start to enter the mixer 21 simultaneously with the starting of stepper motors 8a to 8e. The test run admixable liquid dosage charges form an incoming flow to mixer 21 in the precisely desired predetermined volume ratio, which corresponds to their volume flow rates.

This incoming flow of the test run admixable liquid dosage charges to mixer 21 displaces downstream at the same rate the random mixture of the preliminary run admixable liquids previously filling mixer 21, delivery line 23 and dispenser 24. This causes the preliminary run charges of the admixable liquids to flow through these components of the apparatus 1 and to discharge from spout 25b at that rate. Simultaneously, the incoming flow of admixable liquid dosage charges for the test run is admixed in mixer 21 at the same flow rate, in on-the-fly manner, i.e., by the rotating disc in the mixer as the flow continues at the same rate through mixing path 21a. This forms an outgoing flow of a test batch liquid mixture in which the liquids are precisely in the desired predetermined volume ratio.

The upward movement of pistons 6a to 6e imparts positive hydraulic pressure to the service liquid charges, causing the displaced test run admixable liquid dosage charges to flow through mixer 21 at that pressure, so that the incoming flow of the admixable liquid dosage charges correspondingly displaces the outgoing flow of the produced mixture from the mixer.

As the admixable liquids of the test run dosage charges simultaneously combine in mixer 21, they dilute each other in concordance with their individual volume flow rates, as predetermined by the individual speeds of pistons 6a to 6e.

Mixer 21 is used to achieve rapid, intimate and intensive intermixing of the test run admixable liquid dosage charges by its rotating disc or like conventional mixing element to assure homogeneity of the usually non-homogeneous, e.g., photographic chemical content, liquids that form the mixture. Mixer 21 is not used to draw the admixable liquids thereinto under hydraulic suction or to impart positive hydraulic pressure to the mixture to cause its flow to delivery line 23.

This could cause pressure differentials at local points in the flow of the liquid charges or of the produced mixture, relative to the hydraulic pressure of the flow caused by upward movement of pistons 6a to 6e. Such pressure differentials could cause the admixable liquids to flow non-uniformly and form a mixture in which the liquids are not in desired ratio.

The sole use of pistons 6a to 6e as flow rate controlling means (which are always operated by stepper motors 8a to 8e simultaneously and for the same period of time in feeding the dosage charges of the admixable liquids to mixer 21 in the mixing step of the test run) assures flow uniformity and continuous formation of a mixture batch in which the admixable liquids are always precisely in the desired volume ratio.

Also, because mixer 21 is always completely filled with liquid, no air or other gas can disturb the mixing process. If air were present in mixer 21, the intensive mixing could result in the production of a foam mixture of air and liquid resembling the consistency of whipped cream, rather than a liquid mixture, i.e., a mixture having the consistency of a true liquid, as achieved according to the invention. Such a foam mixture would be detrimental to the operation, as the flow volume of the outgoing mixture would be non-uniform and the foam mixture would be compressible, unlike a true liquid. It would not be displaced by the incoming flow at the desired uniform volume flow rate, nor would it displace the downstream liquid at the same uniform flow rate.

The presence of air or other gas anywhere in apparatus 1 is to be avoided, as these form local air or other gas pockets in dead spaces therein, e.g., in the cylinders, valves and mixer, as well as in the flow lines including the bifurcated lines, dosage tubes, draw lines, charging lines and delivery line to the dispenser.

These pockets prevent the admixable liquids from being completely and uniformaly filled into dosage tubes 11a to 11e in the required volumes for producing a mixture in which the liquids are precisely in the desired volume ratio. They also prevent uniform flow of the admixable liquids and of the produced mixture through the enclosed flow path as required.

If cylinders 5a to 5e contain air pockets, their water charges are not in the required volume ratio, and the same is true of bifurcated lines 4a to 4e and dosage tubes 11a to 11e, as the water charges flow back and forth between the cylinders and dosage tubes via the bifurcated lines. This inaccuracy in the volume ratio of the water charges necessarily causes like inaccuracy in the volume ratio of the admixable liquid charges drawn into dosage tubes 11a to 11e and displaced therefrom to mixer 21 by the inaccurate volume ratio service water charges. Even if the cylinders and bifurcated lines are free from air pockets, any air pockets in the dosage tubes cause the same type inaccuracy in the volume ratio of the admixable liquid charges.

These air pockets can migrate downstream during operation of apparatus 1. If air pockets exist in or migrate downstream in the flow to charging lines 19a to 19e and mixer 21, the flow of admixable liquids to mixer 21 is non-uniform. This can cause non-uniform mixing and production of a mixture in which the liquids are not precisely in the desired volume ratio. This is in addition to the problem of adverse foaming of the mixture during travel through the mixer. Air pockets existing in or migrating further downstream to delivery line 23 and dispenser 24 can cause like non-uniform flow of the formed mixture and inaccurate dispensing from spout 25b.

For these reasons, the apparatus 1 is subjected to the flushing step, and the admixable liquids are fed through the system in the preliminary run, before the test run is undertaken.

In the test run mixing step, the outgoing flow of the liquid mixture from mixer 21 continues to displace the downstream random mixture of the preliminary run admixable liquids from delivery line 23 and dispenser 24 for discharge from spout 25 until pistons 6a to 6e have completed their individually selected extents of partial or complete upward movement, as the case may be. Pistons 6a to 6e thus sweep concordant partial or maximum volumes of cylinders 5a to 5e to provide a swept volume ratio of the cylinders corresponding to the exact volume dosages of the admixable liquids used to form the test run predetermined volume mixture batch, and with the admixable liquids in the desired volume ratio.

At this point, the admixable liquid dosage charges have been completely fed to mixer 21 and admixed to form the mixture batch. The total volume of the test run mixture batch corresponds to the collective volumes of the admixable liquid dosage charges, which are equal to collective volumes swept in cylinders 5a to 5e. When the mixing has been completed, mixer 21, delivery line 23 and dispenser 24 are usually completely filled with the test run mixture batch. A portion of the test run mixture batch will usually have discharged from spout 25b, thereby purging the preliminary run admixable liquids from the system.

It is clear that pistons 6a to 6e are controlled by stepper motors 8a to 8e to move simultaneously at concordant speeds to cause flow of the test run admixable liquid dosage charges simultaneously at volume flow rates corresponding in volume ratio to the ratio of the swept partial or maximum volumes of cylinders 5a to 5e. When pistons 6a to 6e reach the end of their travel toward or to upper position, the test run admixable liquid dosage charges produce a liquid mixture batch corresponding in volume to the collective partial or maximum swept volumes, as the case may be, and with the admixed liquids precisely in the desired volume ratio.

According to the invention, pistons 6a to 6e may be driven simultaneously by stepper motors 8a to 8e, respectively, at any desired individual speed and for a common period of time less than that needed for any or all of the corresponding pistons to reach upper position in their differing maximum swept volume cylinders 5a to 5e. The speed and extend of upward movement of pistons 6a to 6e may be selected to reach individually either the upper empty position or any intervening position in the corresponding cylinder during the common period of time that they are driven by stepper motors 8a to 8e in the mixing step.

That period of common operation is selected in concordance with the individual speeds and extents of piston movement needed to sweep the desired maximum or intermediate volumes of the cylinders to provide the test run admixable liquids in desired ratio and a mixture batch of desired volume.

Accordingly, apparatus 1 is capable of being operated to provide mixer 21 with the admixable liquids in any selective individual volume up to the maximum swept volume of its associated cylinder, and to form a mixture of total volume corresponding to the collective individual volumes of the liquids and in which the liquids are always in the desired volume ratio.

In the test run mixing step, the pistons are operated simultaneously for the exact same period of time in moving toward upper position in the cylinders to assure that the dynamic individual flows of the admixable liquids uniformly correspond to the respective volume flow rates required to be fed simultaneously to the mixer to form a mixture batch in which the liquids are precisely in the desired volume ratio.

If the admixable liquid flows to the mixer 21 were simultaneous but non-uniform, or staggered or successive, the mixture would not contain the liquids precisely in the volume ratio desired. This is because the mixing is effected as the individual admixable liquids travel simultaneously as a dynamic continuous flow through the mixer under the positive hydraulic pressure imparted by the simultaneously moving pistons.

In any case, mixer 21 is deenergized once the simultaneous feeding of the test run admixable liquid dosage charges in the desired volume ratio to mixer 21 has been completed by the one-time unilateral upward partial or complete emptying sweeping movement of pistons 6*a* to 6*e* in cylinders 5*a* to 5*e*. At this point, the mixture batch has been produced and fills mixer 21, delivery line 23 and dispenser 24. Mixer 21 is normally deenergized simultaneously with the common termination of the driving of pistons 6*a* to 6*e* by stepper motors 8*a* to 8*e*.

After the mixing step, a test run purge step is effected. According to the first purge liquid embodiment, in the test run purge step, module E (the water module) alone is used to provide a predetermined further volume of liquid from dosage tube 11*e* as a purge liquid to prepared the test run mixture for dispensing, and to dispense the mixture. The condition of piston 6*e* after the mixing step must be such that it is capable of further upward movement in cylinder 5*e* during the purge step sufficient to feed the required predetermined volume of purge liquid from dosage tube 11*e* via charging line 19*e* to deenergized mixer 21. Also, the condition must be met that some test run mixture has discharged from spout 25*b* to assure that the preliminary run admixable liquid random mixture has been purged completely from the system.

If these two conditions are met, then the adjustment part of the test run purge step may be effected forthwith.

If the first of these two conditions is not met, i.e., if piston 6*e* is not sufficiently below upper empty position in cylinder 5*e* for the purge step, then the third valve 13*e* alone is set to connect tube port 14*e* with supply port 15*e*, and a further draw step of the optional preliminary part of the test run purge step is effected.

In the further draw step of the optional preliminary part of the test run purge step, piston 6*e* alone is driven by stepper motor 8*e* to lower filled position. This draws under suction into cylinder 5*e* the service water charge from dosage tube 11*e*, and simultaneously draws under that same suction into dosage tube 11*e* an equal further charge of liquid (water) from source 17*e* as the purge liquid. Then, third valve 13*e* is set to connect tube port 14*e* with charging port 18*e*.

If the second of these two conditions is not met, i.e., if some test run liquid mixture has not discharged from spout 25*b* to assure complete purging of the preliminary run admixable liquid random mixture, an initial feed step of the optional preliminary part of the test run purge step is effected.

In this initial feed step of the optional preliminary part of the test run purge step, piston 6*e* alone is driven by stepper motor 8*e* a selective preliminary extent toward upper position in cylinder 5*e*. This feeds a selective initial volume of the purge liquid from dosage tube 11*e* via charging line 19*e* to deenergized mixer 21. This in turn displaces residual test run mixture from mixer 21 to delivery line 23 and dispenser 24. This preliminary purge liquid volume is sufficient to cause a portion of the test run mixture to discharge from spout 25*b*, thereby assuring that the preliminary run admixable liquids, that may contain air, have been fully purged from the system.

For the remainder of the purge step, the total volume of the test run mixture located in mixer 21, delivery line 23 and dispenser 24 is designed to provide ample mixture for the discrete volume sample that is to be applied onto web 28 to form the test coating. Usually, the internal volume of delivery line 23 alone is selected to be sufficient to provide the mixture amount needed for the discrete volume sample.

In the adjustment part of the purge step, piston 6*e* alone is backed off slightly, by energizing stepper motor 8*e* to lower piston 6*e* a slight increment. This draws the mixture in dispenser 24 slightly inwardly relative to spout 25*b*. This prevents dripping of the mixture on shifting dispenser 24 to active position 27*a* to effect the dispensing part of the purge step.

Apparatus 1 is now ready for effecting the dispenser shifting and mixture dispensing part of the purge step by shifting dispenser 24 to active position 27*b* to dispense the discrete volume sample portion of the mixture from spout 25*b* onto web 28.

Shifter 26 is operated to shift dispenser 24 to active position 27*b*.

Then, in the dispensing part of the purge step, piston 6*e* alone is driven by stepper motor 8*e* at a selective purging speed or dispensing rate toward upper empty position a selective further distance. This causes a predetermined volume of the purge liquid from dosage tube 11*e* to flow to deenergized mixer 21 via charging line 19*e* at a predetermined dispensing flow rate. This purge liquid volume is just sufficient to displace residual mixture from mixer 21 to delivery line 23 and dispenser 24 for discharging from spout 25*b* a corresponding volume of the mixture at that dispensing flow rate as the discrete volume sample to form the test coating on web 28, i.e., in concordance with the moving speed of web 28.

According to the alternative second purge liquid embodiment, in the test run purge step, module D (the gelatine solution) alone is used to provide a predetermined further volume of liquid from dosage tube 11*d* as the purge liquid to prepare the test run mixture for dispensing, and to dispense the mixture. This second purge liquid embodiment operation is effected in exactly the same manner as described above for the first purge liquid embodiment, the only difference being that cylinder 5*d*, piston 6*d*, stepper motor 8*d*, dosage tube 11*d*, third valve 13*d*, draw line 16*d*, liquid source 17*d* and charging line 19*d* of module D are correspondingly used instead of cylinder 5*e*, piston 6*e*, stepper motor 8*e*, dosage tube 11*e*, third valve 13*e*, draw line 16*e*, liquid source 17*e* and charging line 19*e* of module E.

Apparatus 1 thus constitutes a rapidly and efficiently operating emulsion dilution and delivery system that can produce a mixture batch for use of a portion thereof as a discrete volume sample for an on-line test coating system.

Apparatus 1 particularly permits a silver halide emulsion test liquid as liquid source 17*a* to be formulated rapidly with liquids from some or all of liquid sources 17*b* to 17*e* into a mixture batch having selective volume amounts of the pertinent individual liquids for immediate testing in the test coating system. The test liquid used as liquid source 17*a* may then be replaced by a different emulsion as test liquid for the next mixture batch to be formulated for the next operation.

Apparatus 1 also permits each of the other pertinent liquids as sources 17*b* to 17*e* to be replaced by different liquids as such sources, in addition to or instead of the replacing of liquid source 17*a* for a given test run. For instance, a different photographic emulsion liquid as liquid source 17*a* may require a different hardener as liquid source 17*c* while the other liquids per sources 17*b*, 17*d* and 17*e* are unchanged for that test run. In certain instances, some of the liquid sources may not be used at all for a given test run.

To accommodate a given discrete volume sample to be discharged from spout 25*b* onto web 28 for a test run, delivery line 23 may be replaced by a smaller or larger internal storage volume size delivery line for that test run if the internal volume of the existing delivery line 23 is inappropriate.

The partial or maximum swept volumes of the pistons attained during emptying travel to an intervening position or to upper position in the cylinders, only provides the desired result in the mixing step where the dynamic volume flow rates of the respective service liquids fed to the dosage tubes cause the test run admixable liquid charges to flow simultaneously and uniformly from the dosage tubes to the mixer at the desired dynamic volume flow rates needed to form a mixture in which the liquids are in the proper volume ratio.

It is because of the fulfilling of this basic simultaneous and uniform flow requirement that the operation of apparatus 1 in accordance with the present invention produces a mixture batch of any predetermined volume in which the liquids in the mixture are precisely in any desired volume ratio. Such is achievable because of the facilitating use of stepper motors 8*a* to 8*e* to drive pistons 6*a* to 6*e* in a precise manner.

In this sense, the operation is independent of the maximum swept volumes of the pistons in the cylinders and of their fixed ratio. This is true so long as the individual swept volumes (whether maximum or intermediate swept volumes) of the pistons in the cylinders correspond to the desired individual volume charges of the admixable liquids and their desired ratio, and collectively to the desired mixture batch volume.

Due to the precise results contemplated according to the invention, the respective volumes of dosage tubes 11*a* to 11*e* should concordantly be at least as large as, and preferably should substantially equal, if not slightly exceed, the corresponding respective maximum swept volumes Va to Ve of cylinders 5*a* to 5*e*.

If the volume of any dosage tube were not as large as the maximum swept volume of its associated cylinder, some admixable liquid being drawn into the dosage tube from its associated draw line could possibly enter and contaminate the cylinder. As the operation contemplates dosaging of liquids for preparing a photographic emulsion that usually contains minute silver halide crystals, a hardener and/or other chemicals that can adversely affect the integrity and functioning of the piston and cylinder units, such contamination is to be avoided. Otherwise, the piston and cylinder unit may have to be cleaned, or the unit may have to be removed for servicing.

For this reason, each dosage tube is provided with an operative internal volume at least as large as the maximum swept volume of its associated cylinder. If the volume of any tube exceeds the maximum swept volume of its associated cylinder, the excess volume is filled by a complemental volume of service liquid just as occurs with its associated bifurcated line.

In any module having a dosage tube whose internal volume exceeds the maximum swept volume of its cylinder, the dosage tube and bifurcated line will be filled with service liquid when the piston is at upper position. When the piston is at lower position, the lower portion of the dosage tube will be filled with admixable liquid drawn in via its draw line, while the upper portion and bifurcated line will be filled with service liquid.

Generally, according to one embodiment of the invention, the tube volume at most slightly exceeds the maximum swept volume of its associated cylinder, e.g., by up to about 10%. Preferably, the tube volume in such case generally exceeds that maximum swept volume by up to about 5%, or up to about 7%, or at most up to about 10%. Higher excess tube volume percentages than about 10% relative to the maximum swept volume of the associated cylinder are unnecessary as they provide no significant further benefit, whereas the stated slight excess of up to about 10% is sufficient to prevent entry of a particular admixable liquid into its associated cylinder and resulting contamination thereof.

Normally, however, the operation of apparatus 1 may be carried out using the stated module arrangement, in which each tube volume substantially equals the maximum swept volume of its associated cylinder, without the occurrence of cylinder contamination by the associated admixable liquid.

By providing dosage tubes 11*a* to 11*e* of capillary size, the facing end portions of the opposing columns of service liquid and admixable liquid, located therein during the preliminary and test runs, form an interface that inhibits intermixing of the two opposing liquids. Such intermixing is not pertinent where the service liquid and admixable liquid are the same (e.g., water as service liquid and as the module E liquid source). Subjecting apparatus 1 to the flushing step before each operation keeps the apparatus 1 uncontaminated.

Precise control of the admixable liquid volume flow rates and ratio is achieved because of the characteristics of motors 8*a* to 8*e*, for which purpose stepper motors are singularly advantageous according to the invention. Unlike known mixing systems that produce a commercial scale throughput of a liquid mixture by continuous operation using repeating cycle metering pumps, the invention involves batch operation. The batch operation forms the predetermined volume and ratio mixture batch using precise metering means, exemplified by stepper motors that control the movement of the pistons during the partial or complete single stroke operation used to generate one batch of the desired liquid mixture.

As sources 17*a* to 17*e* are open containers of the admixable liquids whose surfaces are typically in contact with the atmosphere, they form liquid seals with the ends of capillary draw lines 16*a* to 16*e* inserted therein in the manner of pipettes. As dispenser 24 is filled with liquid, the liquid surface at spout 25*b* is also in contact with the atmosphere and forms a liquid seal.

Exposure to the atmosphere of draw lines 16*a* to 16*e* at the liquid seals with sources 17*a* to 17*e*, and of the liquid in dispenser 24 at spout 25*b*, keeps the apparatus 1 at atmospheric pressure when pistons 6*a* to 6*e* are not moving. This is true whether tube ports 14*a* to 14*e* of third valves 13*a* to 13*e* are connected with supply ports 15*a* to 15*e* or charging ports 18*a* to 18*e*. By keeping vent valve 34 open when water valve 31, back flush valve 36 and first valves 3*a* to 3*e* are closed, the water in service line 2 and branch lines 2a to 2e is also at atmospheric pressure.

To form a mixture of desired precise volume ratio, the operation is effected at constant temperature and pressure in the apparatus 1 in the substantial absence of air or other gas. The apparatus 1 must also be free from contaminants that could adversely affect the results of the test to be conducted with the liquid mixture after deposition as a coating on web 28.

Non-uniformity of temperature can adversely change the desired concentration of the constituents in the given mixture. Non-uniformity of pressure can cause non-uniform dosaging of the admixable liquids and non-uniform mixing of their dosage charges, thereby deviating from the desired volume ratio of the admixable liquids in the produced mixture. This will prevent the attaining of the desired concentration of the contained chemical constituents in the test coating.

Constant temperature is achieved by enclosing apparatus 1 in a temperature insulating, e.g., heated, housing (not shown) in conventional manner.

By appropriate use of the various valves, in setting up apparatus 1 for operation, the apparatus 1 can be rendered free from contaminants and from air or other gas by flushing with water supplied via line 31 and by venting to the atmosphere via vent line 33. Water is desirably supplied via water line 31 under elevated delivery pressure (e.g., 20 psig) to achieve rapid and intensive flushing of the pertinent parts of the closed flow path of apparatus 1. This pressure is immediately relieved on closing water valve 32 and opening vent valve 34.

Also, as valves 13a to 13e are continuously open valves, they adjust the system to atmospheric pressure at the liquid seals formed by liquid sources 17a to 17e with the open ends of draw lines 16a to 16e, and also at spout 25, thereby achieving constant or uniform pressure equal to atmospheric pressure.

Since liquid source 17a is normally a light sensitive photographic emulsion, apparatus 1 is operated protectively in the absence of light, e.g., in a dark room. This is a primary reason for providing the pertinent components of apparatus 1 with predetermined volumes, and operating stepper motors 8a to 8e precisely at predetermined concordant speeds for the same predetermined period of time in the mixing step. Only in this way can pistons 6a to 6e be driven to achieve the precise concordant swept volumes in cylinders 5a to 5e that provide the desired precise volume of the mixture in which the liquids are in proper ratio, i.e., in an operation effected in the dark.

For instance, apparatus 1 may be operated in the dark to draw in and process precise respective selective volumes of photographic emulsion of known concentration from liquid source 17a, of surfactant of known concentration from liquid source 17b, of hardener of known concentration from liquid source 17c, of gelatine of known concentration from liquid source 17d, and of distilled or deionized water from liquid source 17e.

At the operating temperature, the produced mixture contains the constituents of the admixed liquids in individual weight/volume concentrations predetermined in concordance with the known weight/volume starting concentrations, e.g., in grams/L, of the liquids in sources 17a to 17e, but diluted in dependence on the charged liquid volumes that form the mixture.

The following examples are set forth by way of illustration and not limitation of the invention.

EXAMPLE 1

Apparatus 1 includes first valves 3a to 3e and second valves 9a to 9e, designated #PV-3-1222 Teflon Hi-Pressure Pneumatic, Normally Open valves, and a set of ganged valves 32, 34 and 34, designated #PBGV-1234-4 Teflon Pneumatic Gang valve (supplied by Mason Flow Controls Inc., Anaheim, CA). It also includes a third valve 13a, designated #AVL6PN6, 0.125' port, valve, third valves 13b and 13c, designated #AVL3PN6, 0.080" port, valves, and third valves 13d and 13e, designated #AVL3PN6, 0.125" port, valves (supplied by Valco Instruments Co., Inc., Houston, TX). Mixer 21 is an enclosed flow path active mixer having a rotatable disc coupled to a high speed (rpm) electric motor, and provided with a manifold entrance 20. The units of cylinders 5a to 5e and pistons 6a to 6e are Stepper Burette Assembly Syringes (supplied by Ionics, Inc., Watertown, MA), used with electric micro-stepper motors having a resolution of 25,000 steps per motor revolution (steps/rev.).

Using distilled hot water at 40° C. and 20 psig pressure supplied by water line 31 as service liquid, distilled hot water at 40° C. as liquid source 17e, and dosage tubes 11a to 11e of internal volumes respectively equal to the maximum swept volumes of their associated cylinders 5a to 5e, apparatus 1 is operated in a dark room at 40° C. to form a test mixture and to dispense a portion thereof as a discrete volume sample onto moving web 28 as a test coating, as follows:

In this example, liquid source 17a is a photographic emulsion of known concentration, liquid source 17b is a surfactant of known concentration, liquid source 17c is a hardener of known concentration, and liquid source 17d is a gelatine solution of known concentration.

This example is carried out according to the first purge liquid embodiment using liquid source 17e (water) as the purge liquid.

The operation of the apparatus 1 of this example is as follows:

I. Flushing Step.

(1) It is assumed that the apparatus 1 is initially configured with first valves 3a to 3e, water valve 32 and back flush valve 36 closed, second valves 9a to 9e and vent valve 34 open, third valves 13a to 13e connecting tube ports 14a to 14e with charging ports 18a to 18e, pistons 6a to 6e at intermediate positions in cylinders 5a to 5e, the previous liquid source 17a and its disposable filter element removed from draw line 19a, mixer 21 deenergized and dispenser 24 at inactive position 27a. First, pistons 6a to 6e are driven to upper empty position at the maximum pressure delivery speed of stepper motors 8a to 8e to fill the service water charges from cylinders 5a to 5e into dosage tubes 11a to 11e.

(2) When pistons 6a to 6e reach upper empty position, first valves 3a to 3e, water valve 32 and back flush 36 are opened, and vent valve 34 is closed. Water from water line 31 flows through service line 2 and branch lines 2a to 2e. One stream of this water flushes bifurcated lines 4a to 4e, dosage tubes 11a to 11e, charging lines 19a to 19e, mixer 21, delivery line 23 and dispenser 24, discharging from spout 25b. Another stream of this water flows via back flush line 35 through back flush port 37 and supply port 15a of third valve 13a to flush exposed draw line 16a.

(3) After about 20–30 seconds, first valves 3a to 3e, water valve 32 and back flush valve 36 are closed, and third valves 13a to 13e are set to connect tube ports 14a to 14*e* with supply ports 15*a* to 15*e*. Bifurcated lines 4*a* to 4*e*, dosage tubes 11*a* to 11*e*, charging lines 19*a* to 19*e*, mixer 21, delivery line 23 and dispenser 24, as well as back flush line 35, are now filled with water. All air has been flushed from the system. Pistons 6*a* to 6*e* remain at upper empty position. The apparatus 1 is now prepared for step (4).

Since only liquid source 17*a* is normally replaced by a different liquid source for the next operation, only draw line 16*a* is cleaned by flushing with water from water line 31, and thus is filled with water. Draw lines 16*b* to 16*d* need not be flushed as liquid sources 17*b* to 17*d* remain the same for the next test, such that draw lines 16*b* to 16*d* remain filled with their respective admixable liquids from the previous test. There is no need to clean draw line 16*e* as liquid source 17*e* is water.

(3a) However, if it is desired to clean draw lines 16*b* to 16*d*, then after step (3), on removing liquid sources 17*b* to 17*d*, and with third valves 13*b* to 13*d* connecting tube ports 14*b* to 14*d* with supply ports 15*b* to 15*d*, water valve 32 is opened. This flushes water via service line 2, branch lines 2*b* to 2*d*, bifurcated lines 4*b* to 4*d*, dosage tubes 11*b* to 11*d*, tube ports 14*b* to 14*d* and supply ports 15*b* to 15*d*, to and out draw lines 16*b* to 16*d*, in analogous manner to that already described. After about 20–30 seconds, the apparatus 1 is configured per step (3) to prepare it for step (4). In this case, draw lines 16*b* to 16*d*, like draw line 16*a*, are now filled with water, whereas draw line 16*e* remains filled with water throughout.

(4) After about 2 further seconds, i.e., after step (3), vent valve 34 is opened to equalize the pressure in service line 2 and branch lines 2*a* to 2*e* to atmospheric pressure. The apparatus 1 is now prepared for step (5). First valves 3*a* to 3*e* and back flush valve 36 remain closed for the remainder of the operation to seal off the downstream portion of the system from service line 2 and branch lines 2*a* to 2*e*. As a precaution, vent valve 34 remains open for the remainder of the operation to relieve the internal pressure on closed first valves 3*a* to 3*e* and back flush valve 36, even though water valve 32 is also closed.

(5) Draw line 16*a*, equipped with a fresh disposable filter element at its lower end, is inserted in the next liquid source 17*a* (the filter element preventing contaminant particles from being drawn up by draw line 16*a*). If step (3a) is performed, the appropriate draw lines 16*b* to 16*d* are also inserted in their next liquid sources 17*b* to 17*d*.

The system is now ready for the preliminary run to remove air that may have entered draw line 16*a* (or any other draw line) by reason of the removal of the previous liquid source and/or the presence of a fresh filter element. The preliminary run also serves to replace the water now filling the flushed draw line 16*a* (or any other flushed draw line) by priming the flushed draw line with admixable liquid from its newly exchanged liquid source.

II. Preliminary Run (6) In a preliminary run draw step, pistons 6*a* to 6*e* are driven to lower filled position at a lower suction intake draw speed (flow rate) that is half the maximum speed of stepper motors 8*a* to 8*e*. This suction intake draw speed is lower than the maximum pressure delivery emptying speed. This provides a sufficiently slow flow rate to inhibit formation of a disturbing temporary vacuum condition upon introduction into the system via any of the lower ends of draw lines 16*a* to 16*e* of the preliminary run charges of the admixable liquids entering from liquid sources 17*a* to 17*e* under the created suction during the preliminary run draw step.

When pistons 6*a* to 6*e* reach lower position, dosage tubes 11*a* to 11*e* and draw lines 16*a* to 16*e*, as the case may be, are filled with preliminary dosage charges of the respective admixable liquids and any attendant flushing water in the same volumes as the corresponding cylinders 5*a* to 5*e*.

Specifically, in the instance where only draw line 16*a* is filled with water consequent the flushing step, this flushing step water enters dosage tube 11*a* ahead of the admixable liquid from liquid source 17*a*. The volume of this flushing step water from draw line 16*a* constitutes a portion of the preliminary dosage charge volume of dosage tube 11*a* corresponding to volume Va of cylinder 5*a*. Thus, when piston 6*a* reaches lower position, the volume of admixable liquid that occupies dosage tube 11*a* is less than the maximum swept volume Va of cylinder 5*a* by an amount equal to the volume of the flushing water therein that previously occupied draw line 16*a*. In this instance, as draw lines 16*b* to 16*d* have not been flushed with water, the respective admixable liquids already present in draw lines 16*b* to 16*d* immediately enter dosage tubes 11*b* to 11*d*, and the admixable liquids alone (i.e., without flushing water) constitute the preliminary dosage charges that occupy dosage tubes 11*b* to 11*d* in the same volumes Vb to Vd as the corresponding cylinders 5*b* to 5*d*, when pistons 6*b* to 6*d* reach lower position.

Similarly, in the instance where draw lines 16*b* to 16*d*, as the case may be, are also filled with water consequent the flushing step, this water enters the respective dosage tubes 11*b* to 11*d* ahead of the admixable liquids from liquid sources 17*b* to 17*d*. The respective volumes of these flushing step water portions from draw lines 16*b* to 16*d* constitute a portion of the preliminary dosage charge volumes of dosage tubes 11*b* to 11*d* corresponding to volumes Vb to Vd of cylinders 5*b* to 5*d*. Accordingly, when pistons 6*b* to 6*d* reach lower position, the respective volumes of the admixable liquids that occupy dosage tubes 11*b* to 11*d* are less than the corresponding maximum swept volumes Vb to Vd of cylinders 5*b* to 5*d* by an amount equal to the concordant volume of flushing water therein that previously occupied the respective draw lines 16*b* to 16*d*.

As liquid source 17*e* is water, and no flushing of draw line 16*e* is required (either in the instance where only draw line 16*a* is flushed, or in the instance where draw lines 16*b* to 16*d*, as the case may be, are also flushed), when piston 6*e* reaches lower position, dosage tube 11*e* is filled with a preliminary dosage charge of water as admixable liquid inherently in the same volume Ve as cylinder 5*e*.

(7) Next, in a preliminary run emptying step, third valves 13*a* to 13*e* are set to connect tube ports 14*a* to 14*e* with charging ports 18*a* to 18*e*, and pistons 6*a* to 6*e* are driven at maximum speed to upper position to displace the preliminary run charges to and through charging lines 19*a* to 19*e*, deenergized mixer 21, delivery line 23 and dispenser 24. These preliminary run charges displace the water previously filling charging lines 19*a* to 19*e*, mixer 21, delivery conduit 23 and dispenser 24. This causes the water to discharge from spout 25*b*. A portion of the random mixture of the preliminary run charges also discharges from spout 25*b*. Charging lines 19*a* to 19*e* are now filled with a portion of the respective preliminary run charges from dosage tubes 11*a* to 11*e* that contain the corresponding admixable liquids from liquid sources 17*a* to 17*e* and any attendant flushing water.

(8) Then, third valves 13*a* to 13*e* are set to connect tube ports 14*a* to 14*e* with supply ports 15*a* to 15*e*.

The apparatus 1 is now ready for effecting the dilution sequence to charge the admixable liquids from sources 17*a* to 17*e* to mixer 21 to form the test run liquid mixture.

III. Test Run Draw Step (9) With mixer 21 deenergized, dispenser 24 at inactive position 27*a*, first valves 3*a* to 3*e*, water valve 32 and back flush valve 36 closed, second valves 9*a* to 9*e* and vent valve 32 open, third valves 13*a* to 13*a* connecting tube ports 14*a* to 14*e* with supply ports 15*a* to 15*e*, and pistons 6*a* to 6*e* at upper empty position, the pistons are driven at lower suction intake draw speed to lower filled position. This draws water under suction from dosage tubes 11*a* to 11*e* via bifurcated lines 4*a* to 4*e* into cylinders 5*a* to 5*e*, precisely filling the cylinders with water charges corresponding to volumes Va to Ve.

By pipette action, this simultaneously also draws under that same suction the respective admixable liquids from sources 17*a* to 17*e* via draw lines 16*a* to 16*e*, and supply ports 15*a* to 15*e* and tube ports 14*a* to 14*e* of third valves 13*a* to 13*e*, into dosage tubes 11*a* to 11*e*. Dosage tubes 11*a* to 11*e* are filled with test run dosage charges of the admixable liquids precisely in the same ratio and amounts as volumes Va to Ve.

(10) When the admixable liquid dosage charges have filled dosage tubes 11*a* to 11*e*, third valves 13*a* to 13*e* are set to connect tube ports 14*a* to 14*e* with charging ports 18*a* to 18*e*.

IV. Test Run Fill Step

(11) Pistons 6*a* to 6*e* are driven at selective individual speeds by stepper motors 8*a* to 8*e* to displace the test run charges from dosage tubes 11*a* to 11*e* in respective volumes just sufficient to fill charging lines 19*a* to 19*e*. This primes charging lines 19*a* to 19*e* with the test run admixable liquids for the mixing step, while displacing the preliminary run charges previously filling the charging lines to mixer 21, thereby discharging a like volume of the preliminary run charges from spout 25*b*. This fill step priming of charging lines 19*a* to 19*e* with the test run admixable liquids assures that any content of flushing step water or air or other gas in the preliminary run charge portion previously occupying any of the charging lines, has been purged therefrom. It also assures that the admixable liquids will be fed immediately and in proper volume ratio and concentration to mixer 21 in the ensuing test run mixing step.

V. Test Run Mixing Step

(12) Mixer 21 is energized and at the same time pistons 6*a* to 6*e* are driven at individual selective speeds toward upper position to empty predetermined volumes of their water into dosage tubes 11*a* to 11*e* to refill the tubes precisely therewith in like volume amounts. The test run admixable liquid dosage charges are simultaneously displaced from dosage tubes 11*a* to 11*e* in like volume amounts via charging lines 19*a* to 19*e* to mixer 21 for admixing.

Stepper motors 8*a* to 8*e* are energized at predetermined individual speeds (i.e., dilution speeds) concordant to the desired predetermined volumes of the admixable liquid dosage charges to displace the charges from dosage tubes 11*a* to 11*e* at volume flow rates corresponding precisely to the desired ratio for admixing as a continuous stream in mixer 21 to form a mixture as a like stream conforming to that ratio.

When pistons 6*a* to 6*e* reach their respective final (intermediate swept volume) positions, the precise volumes of the admixable liquid dosage charges are simultaneously completely displaced from dosage tubes 11*a* to 11*e* and mixed by mixer 21, save for the amounts thereof left in charging lines 19*a* to 19*e*. The latter amounts correspond to the fill step priming amounts initially fed to charging lines 19*a* to 19*e* and which are fed to mixer 21 in the mixing step in their place.

Since the admixable liquid dosage charges are displaced to mixer 21 at predetermined volume flow rates, and since their collective volumes substantially exceed the internal volume of mixer 21, the mixture as it is formed is displaced from the mixer to delivery line 23 and dispenser 24. Some of the mixture discharges from spout 25*b*, thereby purging the preliminary run admixable liquids from the system.

(13) When the admixable liquids have been completely charged to mixer 21, the mixer is deenergized. This occurs simultaneously with the common termination of the driving of pistons 6*a* to 6*e* by stepper motors 8*a* to 8*e*. The remaining portion of the mixture formed in the test run, now located in mixer 21, delivery line 23 and dispenser 24, is not only sufficient to provide the discrete volume sample needed for the test coating, but is free from air that can disturb the dispensing of that sample in the precise volume desired.

Because the amount of service water in cylinder 5*e* at this point is sufficient for the test run purge step, according to the first purge liquid embodiment using water as purge liquid, and because some of the test run mixture has discharged from spout 25*b*, the further draw step and initial feed step of the optional preliminary part of the purge step may be omitted.

(13a) However, if the amount of water in cylinder 5*e* is insufficient for the test run purge step, then a further draw step of the preliminary part of the test run purge step is effected. Specifically, piston 6*e* alone is driven by stepper motor 8*e* to lower position to fill cylinder 5*e* with water from dosage tube 11*e* and draw a further charge of water from liquid source 17*e* into dosage tube 11*e*.

(13b) Also, if the mixture batch volume produced is insufficient to cause discharge of some test run mixture from spout 25*b* during the mixing step, for purging the remaining preliminary run admixable liquids from the system, then an initial feed step of the preliminary part of the test run purge step is effected. Specifically, piston 6*e* alone is driven by stepper motor 8*e* a selective increment toward upper position to displace a water amount from dosage tube 11*e* to mixer 21 sufficient to discharge some test run mixture from spout 25*b* for purging the remaining preliminary run admixable liquids.

VI. Adjustment Part of Test Run Purging Step

(14) Piston 6*e* alone is backed off slightly by energizing stepper motor 8*e* to lower piston 6*e* by a slight increment. This draws the mixture portion in dispenser 24 slightly inwardly relative to spout 25*b* to prevent dripping of the mixture on shifting dispenser 24 to active position 27*a*.

The test run mixture is now ready for dispensing the discrete volume sample portion thereof onto moving web 28.

VII. Shifting and Dispensing Part of Test Run Purging Step

(15) Shifter 26 is operated to shift dispenser 24 to active position 27*b*. Then, piston 6*e* alone is driven toward upper empty position by stepper motor 8*e* at a predetermined coating or dispensing speed or flow rate. This displaces the liquid in dosage tube 11*e* as a purge liquid via charging line 19*e* to mixer 21 to displace in turn the mixture in dispenser 24 from spout 25*b* at that same dispensing flow rate. The mixture leaving spout 25*b* is coated at that same rate onto moving web 28 as a discrete volume sample of like amount to the purge liquid displaced from dosage tube 11*e*.

(16) On completing the coating operation, dispenser 24 is shifted to inactive position 27*a*, liquid source 17*a* and its filter element are removed from draw line 16*a*, and the system is configured for step (1) to repeat the operation for the next liquid source 17*a*.

Only water is filled into and emptied from cylinders 5*a* to 5*e*, and flows in service line 2, branch lines 2*a* to 2*e*, bifurcated lines 4*a* to 4*e* and back flush line 35. The admixable liquids from sources 17*a* to 17*e* only flow in draw lines 16*a* to 16*e*, dosage tubes 11*a* to 11*e* and charging lines 19*a* to 19*e* of modules A to E. Stepper motor driven syringes are used in the test run to deliver to mixer 21 chemical component liquids in a continuous stream at proper dilution ratio and flow rates. Then, syringe delivery of purge liquid is used to feed the formed mixture in desired ratio to delivery line 23 to dispense from dispenser 24 a discrete volume sample thereof at a dispensing flow rate to coat a web for testing.

While five modules A to E are shown in the example of apparatus 1 given in FIG. 1, it will be understood that any number of modules may be provided, such as a lesser number, e.g., three or four, or any greater number, e.g., six, seven, eight, etc., as desired. Other modules may be used to supply other liquids that may be used in photographic emulsion formulations such as dyes, chemical couplers, etc.

The piston and cylinder units formed by cylinders 5*a* to 5*e*, pistons 6*a* to 6*e* and piston rods 7*a* to 7*e*, plus their associated stepper motors 8*a* to 8*e*, and dosage tubes 11*a* to 11*e*, may be replaced by other components of different cylinder maximum swept volumes Va to Ve and concordant dosage tube internal volumes, and different stepper motor characteristics. Delivery line 23 may also be replaced by a different internal storage volume size delivery line.

Depending on the characteristics of the admixable liquids and of the produced mixture, and the influence of temperature thereon, apparatus 1 may operate at any temperature from about room temperature to a hot water temperature below the boiling point of water, e.g., about 20°-95° C. (68°-203° F.), preferably about 30°-80° C. (86°-176° F.), especially about 35°-50° C. (77°-122° F.), and particularly about 40° C. (104° F.).

Use of a hot water temperature for the operation inhibits premature setting of the gelatine content in the mixture, and may also condition the resulting diluted photographic emulsion. However, the temperature must be below that which would cause premature hardening of the resulting diluted photographic emulsion by reason of any hardener present, or development of fogging or other adverse condition of the sample coated on web 28 that would disturb the integrity of the ensuing test.

The arrangement of apparatus 1 is such that it lends itself to automatic controlled program operation in the dark. This is because the valves, stepper motors, mixer and shifter, are each individually independently actuatable. The valves and the shifter may be operated by respective solenoids (not shown), and the stepper motors and the mixer may be electrically energized by switches, all under servo-control.

The sequence and time periods of individual or simultaneous operation of the valves, stepper motors, mixer and shifter, as the case may be, which are precisely controllable in predetermined manner to effect steps (1) to (16), and (3a), (13a) and (13b) if needed, may be readily pre-programmed.

Figure 2:
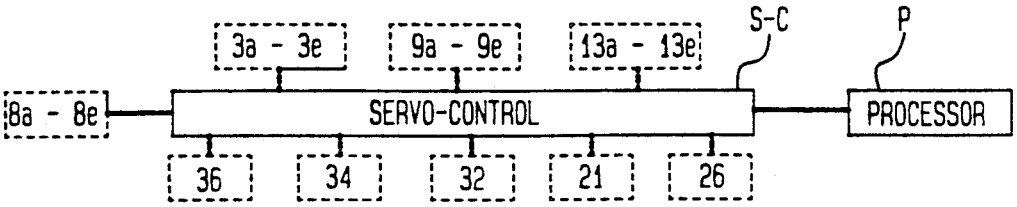
FIG. 2 is a schematic view of a control system for operating the apparatus of FIG. 1.

Referring now to FIG. 2, a conventional servo-control system S-C, operated by a computer processor P in known manner, is shown schematically. Servo-control system S-C may be operated by processor P to control the individual operation of each of first valves 3*a* to 3*e*, second valves 9*a* to 9*e*, third valves 13*a* to 13*e*, water valve 32, vent valve 34, back flush valve 36, stepper motors 8*a* to 8*e*, mixer 21 and shifter 26. These may be controlled to perform steps (1) to (16), and (3a), (13a) and (13b) if needed, and to repeat the steps on resetting apparatus 1 for the next test mixture.

By pre-programming the operation, the steps can be effected precisely and rapidly in the dark with accurate dosage charging and mixing of the admixable liquids, and accurate dispensing of the mixture onto web 28, in a pre-timed cycle.

EXAMPLE 2

Example 1 is repeated using the servo-control system S-C operated by computer processor P of FIG. 2 to control the operation of apparatus 1. In this case, however, liquid source 17*c*, i.e., the hardener, is not used in forming the mixture. This illustrates the adaptability of apparatus 1 for use with less than all of the available liquid supply modules.

Table 1 shows pertinent system constants for operating apparatus 1 per steps (1) to (16), and (3a), (13a) and (13b) if needed, as a five module system, but with module C (the hardener module) only used in the test run fill step to fill charging line 19*c* for system balance (see Table 3).

TABLE 1

| | System Constants | | | | |
|---|---|---|---|---|---|
| | Module | | | | |
| Component | A | B | C | D | E |
| Cylinder Vol., cc | 25.0 | 2.5 | 5.0 | 25.0 | 25.0 |
| Dosage Tube | | | | | |
| I.D., in. | 0.1250 | 0.0625 | 0.0625 | 0.1250 | 0.1250 |
| Vol., cc | 25.0 | 2.5 | 5.0 | 25.0 | 25.0 |
| Draw Line | | | | | |
| I.D., in. | 0.1250 | 0.0625 | 0.0625 | 0.1250 | 0.1250 |
| Length, in. | 24.00 | 24.00 | 24.00 | 24.00 | 24.00 |
| Vol., cc* | 4.828 | 1.207 | 1.207 | 4.828 | 4.828 |
| Charging Line | | | | | |
| I.D., in. | 0.1250 | 0.0625 | 0.0625 | 0.1250 | 0.1250 |
| Length, in. | 13.00 | 5.00 | 7.50 | 16.50 | 21.00 |
| Vol., cc* | 2.615 | 0.251 | 0.377 | 3.319 | 4.224 |

*Calculated

In Table 1, the cylinder volume is the volume per piston stroke (maximum swept volume), and the dosage tube volume is the operative volume that corresponds to the cylinder volume (maximum swept volume) of the cylinder of the same module.

Table 2 shows further system constants cumulative to those in Table 1 for the modules and other components of apparatus 1.

TABLE 2

| Further System Constants | |
|---|---|
| Component | Constant |
| Cylinders Total Vol., cc | 82.5 |
| Dosage Tubes Total Vol., cc | 82.5 |
| Charging Lines Total Vol., cc* | 10.786 |
| Mixer Vol., cc | 15.00 |
| Delivery Line | |
| I.D., in. | 0.1250 |
| Length, in. | 18.00 |
| Vol., cc* | 3.621 |
| Dispenser Vol., cc | 1.200 |
| Stepper Motors | |
| Resolution, steps/rev. | 25000. |
| Total Rev./stroke | 50. |
| Max. Speed, Hz | 100000. |
| Draw Speed, Hz | 50000. |
| Valves Switching Time, sec. | 4. |

*Calculated

Table 2 shows that the draw speed (in Hz) of the stepper motors, when operated in the draw step to draw the admixable liquids from their sources via the draw lines into the dosage tubes, is half the maximum speed of the stepper motors. At 25,000 steps per revolution, the stepper motors execute 1,250,000 steps to achieve a maximum swept volume movement of the pistons from one to the other end of their respective cylinders. This permits extremely precise dosaging of the admixable liquids for the purposes of the invention.

As to the stepper motor characteristics, the pulse is the reciprocal of the stepper motor speed or frequency (100,000 Hz), expressed in microseconds (10/sec), and the pulse width corresponds to the square wave length of the frequency in microseconds per pulse (/sec/-pulse). The /sec/pulse value indicates the stepper motor speed. The maximum pulse width (5/sec), which is one-half of the reciprocal of the frequency (10/sec), is the smallest pulse width attainable with the stepper motors and operates the stepper motors at maximum speed.

Based on the given and calculated data of Tables 1 and 2, Table 3 shows related performance data of the modules of the apparatus 1 in effecting the test run, including values as to the above noted stepper motor characteristics. After the draw step, the module C stepper motor is only operated in the fill step to prefill and prime its charging line for system balance. Then, only the stepper motors of modules A, B, D and E are operated in the mixing step, after which only the module E stepper motor is operated in the purge step to dispense the discrete volume sample. The times given in Table 3 are the energized operating times of the stepper motors. The mixer is energized to operate simultaneously with the stepper motors in the mixing step, and thus for a time equal to the mixing time.

TABLE 3

| Performance Data | | | | | | |
|---|---|---|---|---|---|---|
| | Module | | | | | |
| Item | A | B | C | D | E | Total |
| Dosage Tube #1 Draw Time, sec. | — | — | — | — | — | 25.000 |
| Charging Line #2 Flow Rate cc/sec | 2.0 | .2 | 0.4 | 2.0 | 2.0 | — |
| Fill Time, sec. | 1.307 | 1.257 | 0.943 | 1.659 | 2.112 | — |
| Vol., cc | 2.615 | 0.251 | 0.377 | 3.319 | 4.224 | 10.786 |
| Mixer Feed #3 Flow Rate | | | | | | |
| cc/sec | 0.061 | 0.034 | 0 | 2.000 | 1.429 | — |
| Time, sec. | 9.603 | 9.603 | 0 | 9.603 | 9.603 | — |
| Vol., cc | 0.582 | 0.331 | 0 | 19.206 | 13.718 | 33.837 |
| Purge Water #4 Vol., cc | — | — | — | — | 2.432 | 2.432 |
| Liquids Used Total Vol., cc | 3.197 | 0.582 | 0.377 | 22.525 | 20.374 | 47.055 |
| Stepper Motor #5 Pulse Width /sec/pulse | | | | | | |
| Max. | 5 | 5 | 5 | 5 | 5 | — |
| Draw | 10 | 10 | 10 | 10 | 10 | — |
| Mixing | 165 | 29 | — | 5 | 7 | — |

#1 The draw time is the draw step time for drawing the liquids from the sources into the dosage tubes.
#2 The flow rate is the fill step flow rate of the liquids fed to the charging lines. The volume is the charging line volume calculated in Table 1. Fill time is calculated by dividing the volume by the flow rate.
#3 The flow rate is the mixing step flow rate of the liquids fed to the mixer (at the desired mixing volume ratio). The volume is the mixing volume. Mixing time is calculated by dividing the volume by the flow rate.
#4 Module E supplemental water used in purge step to dispense a like amount of the mixture as the discrete volume sample.
#5 The pulse width values indicate the stepper motor maximum speed, draw step speed, and mixing step speed.

In the dispensing step for coating the 2.432 cc discrete volume sample onto the web, the module E stepper motor is operated for an 18.5 sec. dispensing or coating time at a 6578.947 Hz dispensing or coating speed (frequency) to achieve a calculated 0.131 cc/sec mixture dispensing flow rate by the 2.432 cc purge water volume of the module E fed to the mixer.

It will be noted from Table 3 that the fill time is based on the individual diameter and length of the given charging line 19*a* to 19*e* and the individual syringe (piston and cylinder unit) flow rate while charging the given line 19*a* to 19*e*. Thus, regarding module C, for example, as charging line 19*c* has a calculated volume of 0.377 cc and is charged at a flow rate of 0.4 cc/sec, the required fill time is 0.943 seconds ($0.4 \times 0.943 = 0.377$).

The mixer feed volumes in Table 3 show that the mixture batch contains the module A, B, D and E liquids in the volume ratio of 0.582 (A) to 0.331 (B) to 19.206 (D) to 13.718 (E), as explained below in regard to Table 4.

Table 2 shows a 10.786 cc total volume for the charging lines, and a 19.821 cc total volume as the sum of the 15.00 cc mixer volume, 3.621 cc delivery line volume and 1.200 cc dispenser volume, for a combined total of 30.607 cc. Based on the data in Tables 1 and 2, Table 3 correspondingly shows that, of the 47.055 cc total volume of liquids used in the test run, 10.786 cc are in the charging lines and 33.837 cc are mixed in the mixing step, leaving 2.432 cc of purge liquid that corresponds to the dispensed discrete volume sample.

As the mixer, delivery line and dispenser volumes total 19.821 cc (Table 2), 14.016 cc of the 33.837 cc mixture (Table 3) discharge from the spout during the mixing. This 14.016 cc discharged mixture volume purges the preliminary run liquids previously in the mixer, delivery line and dispenser. The residual 19.821 cc of the mixture is ample for providing the 2.432 cc discrete volume sample.

The Example 1 step (14) is performed in Example 2 by backing off piston 6*e* an increment corresponding to a backing off volume of approximately 0.5 cc (to prevent dripping from spout 25*b*), prior to shifting dispenser 24 from inactive position 27*a* to active position 27*b*. On effecting dispensing of the discrete volume sample onto web 28 at active position 27*b*, piston 6*e* is moved upwardly in cylinder 5*e* an adjusting compensating amount corresponding to a restoring volume of 0.5 cc, so that the actual liquid volume is the correct amount, i.e., determined as if the backing off step (14) had not taken place. Since the restoring volume equals the backing off volume, the exact amount of this small volume is not critical.

The Example 1 steps (13a) and (13b) are not needed, since the reserve amount of water in the dosage tube of module E is sufficient to provide the required 2.432 cc of purge liquid to dispense the discrete volume sample, and also since some of the mixture discharges from the spout during the mixing.

Table 4 shows a statistical analysis of Table 3 data regarding the volume ratio of the module A, B, D and E liquids in terms of their individual mixture feed flow rates for the common 9.603 second feed (and mixing) time, their individual volumes in the 33.837 cc mixture batch produced, and their individual volumes in the 2.432 cc dispensed discrete volume sample based on their individual volumes in the mixture batch.

TABLE 4

| Mixture Batch and Dispensed Sample Analysis | | | | | |
|---|---|---|---|---|---|
| | Module | | | | |
| Item | A | B | D | E | Total |
| Batch Flow Rate | | | | | |
| cc/sec | 0.061 | 0.034 | 2.000 | 1.429 | — |
| Ratio | 1 | 0.56 | 32.79 | 23.43 | — |
| Vol., cc 33.837 | 0.582 | 0.331 | 19.206 | 13.718 | |
| Ratio | 1 | 0.57 | 33.0 | 23.57 | — |
| Sample Vol., cc 2.432 | 0.042 | 0.024 | 1.380 | 0.986 | |
| Ratio | 1 | 0.57 | 32.86 | 23.48 | — |

Table 4 demonstrates that the volume ratio of the module A, B, D and E liquids to each other is reproducibly obtainable according to the invention, at negligible statistical variation among the data of Tables 1 to 3 for close agreement of the flow rate volume ratio with the mixture batch volume ratio and dispensed sample volume ratio.

EXAMPLE 3

Example 2 is repeated, except that the procedure is carried out according to the second purge liquid embodiment using liquid source 17*d* (aqueous gelatine solution) as the purge liquid, instead of the first purge liquid embodiment using liquid source 17*e* (water) as the purge liquid.

The same results are achieved, except that in this case 2.432 cc of gelatine solution are used as the purge liquid, so that the module D total liquid used amounts to 24.957 cc (22.525 cc plus 2.432 cc) while the module E total liquid used amounts to 17.942 cc (20.374 cc less 2.432 cc).

Example 3 illustrates the repeatability of the operation in using apparatus 1 according to the invention. In fact, it has been found that the operation performs more efficiently and responsively using the gelatine solution per module D as the purge liquid to displace the coating mixture for dispensing the discrete volume sample onto web 28 according to the alternative second purge liquid embodiment, rather than water per module E as the purge liquid according to the first purge liquid embodiment. This is considered to be due to the high viscosity of the liquid as constituted by the gelatine solution compared to the low viscosity of the liquid as constituted by water.

This is of advantage when the more viscous purge liquid constituted by the module D gelatine solution contacts the mixture batch rearmost portion in the mixer, as there is less tendency for the purge liquid to intermix with the mixture batch as it progressively displaces the batch from the relatively large flow cross section of the mixing path to the relatively small capillary flow cross section of the delivery conduit. On the other hand, when the less viscous purge liquid constituted by the module E water contacts the mixture batch rearmost portion in the mixer, there may be some tendency for such intermixing. This tendency for intermixing does not manifest itself in the case of the contact between the service liquid and the pertinent admixable liquids in the dosage tubes because of the mixture inhibiting capillary flow cross sectional size of the dosage tubes, as earlier explained.

It will be understood that the apparatus and method of the invention are not limited to forming a photographic emulsion mixture batch, but contemplate the combining simultaneously of predetermined dosage charges of any admixable liquids to form a mixture batch in which the volumes of the liquids are precisely in desired predetermined ratio for any purpose.

Also, at larger mixer volumes, any controlled drive system, such as an analogous arrangement of DC motors (i.e., of individually infinitely variable speed) with feedback, in conventional manner, can be used in place of the more precisely operating stepper motors. Thus, where the module A to E cylinder volumes are respectively 25, 2.5, 5, 25 and 25 liters (L), rather than 25, 2.5, 5, 25 and 25 cubic centimeters (cc) as shown in Table 1 of Example 2, and the other volumes and flow rates of Tables 1 to 4 are correspondingly in liters and liters/sec, analogous results are obtainable.

Specifically, at a total charging line volume of 10.786 L, a total mixer feed volume of 33.837 L and a purge liquid volume of 2.432 L (i.e., of module E water per Examples 1 and 2, or of module D gelatine solution per Example 3), for a total liquids used volume of 47.055 L, and operating apparatus 1 with such a DC motor arrangement in place of the stepper motor arrangement, 2.432 L of the discrete volume sample may be concordantly deposited onto web 28, consistent with the results shown in Table 4 of Example 2.

Nevertheless, because of the precise results achievable by operation of apparatus 1 according to the invention, the enclosed flow system constituted by apparatus 1 is advantageously usable to produce relatively small mixture batches, e.g. up to about 0.5 liter, or at most up to about 1 liter, in amount, in an initial mixing step, for non-pulsating uniform (constant) flow rate dispensing of a discrete volume thereof in a subsequent dispensing step. This is especially true where the produced liquid mixture is labile (unstable), such as a photographic emulsion coating type mixture as discussed above. The flushing step, preliminary run and test run can be efficiently carried out in a very short overall period of time (measured in terms of seconds rather than minutes), such that any dissolved air or other gas in the incoming flushing water (supplied via water line 31) has insufficient time to be released in the enclosed flow system under the extant conditions during the operation.

Accordingly, it can be appreciated that the specific embodiments described are merely illustrative of the general principles of the invention. Various modifications may be provided consistent with the principles set forth.

What is claimed is:

1. Apparatus comprising an enclosed flow arrangement for providing a predetermined volume batch of a mixture of a plurality of liquids in which the volumes of the liquids in the mixture are in a predetermined ratio, the apparatus comprising:

a service line;

a mixer, energizable for mixing liquids, having an entrance and an exit, and a mixing path connecting the entrance and exit;

a dispenser;

a delivery conduit connecting said mixer exit to said dispenser for receiving the mixture of liquids from said mixer for delivery to said dispenser for dispensing from said dispenser; and a plurality of liquid supply modules, each of said modules comprising:

means for supplying a respective one of the liquids;

a piston and cylinder unit having an inlet and outlet;

drive means for selectively driving the piston relative to the cylinder between extreme positions thereof or to any predetermined intervening position in the cylinder intermediate said extreme positions;

said piston and cylinder unit having a predetermined maximum volume swept by the piston when moving from one to the other of said extreme positions;

a tube having opposed ends and a predetermined internal volume between said tube ends that is at least as large as the maximum swept volume of the cylinder;

a main valve for connecting said inlet and outlet to said service line;

one said end of said tube being connected to said inlet and outlet; and an alternate flow valve for selectively connecting the other said end of said tube either to said supplying means or to said mixer entrance.

2. The apparatus of claim 1 wherein each of said modules has a said tube whose internal volume is substantially equal to the maximum swept volume of said piston and cylinder unit of the same said module.

3. The apparatus of claim 1 further comprising control means for selectively individually controlling the driving of each said drive means, the operation of each said valve, and the energizing of said mixer.

4. The apparatus of claim 3 wherein each said drive means is an individually selectively operated variable speed stepper motor.

5. The apparatus of claim 1 further comprising shifting means for shifting said dispenser between an inactive position and an active position for dispensing the mixture of liquids from said dispenser when said dispenser is shifted to said active position.

6. The apparatus of claim 5 wherein said dispenser has a receiving inlet and a discharge spout, and said delivery conduit connects said mixer exit to said receiving inlet for receiving the mixture of liquids from said mixer for delivery via said receiving inlet to said dispenser for dispensing from said discharge spout.

7. The apparatus of claim 5 further comprising control means for selectively individually controlling the driving of each said drive means, the operation of each said valve, the energizing of said mixer, and the shifting of said shifting means.

8. The apparatus of claim 1 wherein each said drive means is an individually selectively operated variable speed stepper motor.

9. The apparatus of claim 8 wherein:

each of said modules further comprises a charging conduit of predetermined internal volume for selectively connecting each said alternate flow valve to said mixer entrance;

said mixing path, delivery conduit and dispenser each has a predetermined internal volume; and the sum of said maximum swept volumes of said plurality of modules exceeds the sum of the collective internal volumes of said charging conduits plus the internal volumes of said mixer, delivery conduit and dispenser.

10. The apparatus of claim 9 wherein each said tube is a capillary tube, each said charging conduit is a capillary charging conduit, and said delivery conduit is a capillary delivery conduit.

11. The apparatus of claim 10 further comprising a vent valve for venting said service line to the atmosphere, and a service valve for supplying a service liquid to said service line.

12. The apparatus of claim 11 further comprising a back flush conduit having an upstream end and a downstream end, and a back flush valve for connecting said upstream end to said service line; one module of said plurality having a said alternate flow valve comprising supplemental valve means for connecting said downstream end of said back flush conduit to said supplying means of said one module when that said alternate flow valve selectively connects said other end of said tube of said one module via the charging conduit thereof to said mixer entrance.

13. The apparatus of claim 12 further comprising control means for selectively individually controlling the driving of each said stepper motor, the operation of each said valve, and the energizing of said mixer.

14. The apparatus of claim 13 further comprising shifting means controlled by said control means for shifting said dispenser between an inactive position and an active position for dispensing the mixture of liquids from said dispenser when said dispenser is shifted to said active position.

15. A method of combining a plurality of liquids in a predetermined volume ratio to form a predetermined volume batch of a mixture of the liquids for dispensing from a dispenser, the method comprising:

effecting the following steps in the substantial absence of attendant gases in an enclosed flow system having a mixer connected by a delivery conduit to a dispenser:

feeding simultaneously respective predetermined volume charges of a plurality of admixable liquids in a predetermined volume ratio to the mixer at individual flow rates to form an incoming flow of the liquids in said ratio while mixing the incoming flow in the mixer to form an outgoing flow of a mixture of the liquids in said ratio, such that the incoming flow displaces the outgoing flow from the mixer to the delivery conduit; and upon completing the feeding of said charges in said ratio, terminating the mixing and feeding a selective volume of a purge liquid to the mixer to displace a like volume of residual mixture from the mixer to the delivery conduit and to dispense a corresponding volume of the mixture from the dispenser.

16. The method of claim 15 including feeding said purge liquid to the mixer at a selective dispensing rate so as to cause dispensing of the mixture from the dispenser at said dispensing rate.

17. A method of combining a plurality of liquids in a predetermined volume ratio to form a predetermined volume batch of a mixture of the liquids for dispensing from a dispenser, the method comprising the steps of:

establishing an enclosed flow system of:

a plurality of chambers capable of being filled with a service liquid and emptied of the service liquid, and having respective selective volumes;

a like plurality of dosage tubes each associated with and having a volume at least as large as the volume of a respective chamber, each tube having a first end and a second end;

a like plurality of liquid sources each of a respective admixable liquid and each associated with a respective tube; and a mixer connected by a delivery conduit to a dispenser; and effecting the following steps in the substantial absence of attendant gases in the enclosed flow system:

filling each of the chambers and each of the tubes with a volume of the service liquid corresponding to their individual respective volumes;

emptying the volumes of service liquid from the chambers into their associated tubes via the first ends of the tubes to displace respective corresponding volumes of the service liquid from the tubes via the second ends of the tubes;

withdrawing under suction service liquid from the tubes via said first ends into their associated chambers in respective corresponding volumes to fill the chambers, while also drawing under said suction into the tubes via said second ends respective corresponding volumes of the admixable liquids from their associated sources;

at least partially respectively emptying simultaneously the service liquid from the chambers into their associated tubes via said first ends at individual flow rates sufficiently to displace predetermined volume charges of the respective admixable liquids in a predetermined volume ratio from the tubes via said second ends and to feed simultaneously said charges to the mixer at said individual flow rates to form an incoming flow of the admixable liquids in said ratio, while also mixing the incoming flow in the mixer to form an outgoing flow of a mixture of the liquids in said ratio, such that the incoming flow displaces the outgoing flow from the mixer to the delivery conduit and in turn to the dispenser; and upon completing the feeding of said charges in said ratio, terminating the mixing and feeding a selective volume of a purge liquid to the mixer to displace a like volume of residual mixture from the mixer to the delivery conduit and to dispense a corresponding volume of the mixture from the dispenser, the feeding of said purge liquid to the mixer being effected at a selective dispensing rate to cause dispensing of the mixture from the dispenser at said dispensing rate.

18. The method of claim 17 wherein the liquid sources include a source of water and the purge liquid is water from said source of water.

19. The method of claim 18 wherein the liquid source further comprise a source of a photographic emulsion, said service liquid and said source of water are distilled or deionized water, and the method is effected in the absence of light.

20. The method of claim 19 wherein the source of said photographic emulsion is replaced by a source of a different photographic emulsion, and said steps are repeated.

21. The method of claim 19 wherein the enclosed flow system is at about atmospheric pressure, and the method is effected at an elevated temperature corresponding to a selective hot water temperature below the boiling point of water.

22. The method of claim 17 wherein the liquid sources include a source of a gelatine solution and the purge liquid is gelatine solution from said source of gelatine solution.

23. The method of claim 22 wherein the liquid sources further comprise a source of a photographic emulsion and a source of water, said service liquid and said source of water are distilled or deionized water, and the method is effected in the absence of light.

24. The method of claim 23 wherein the source of said photographic emulsion is replaced by a source of a different photographic emulsion, and said steps are repeated.

25. The method of claim 23 wherein the enclosed flow system is at about atmospheric pressure, and the method is effected at an elevated temperature corresponding to a selective hot water temperature below the boiling point of water.

* * * * *